US009566987B2

(12) United States Patent
Coutre et al.

(10) Patent No.: US 9,566,987 B2
(45) Date of Patent: Feb. 14, 2017

(54) LOW-PRESSURE ENVIRONMENT STRUCTURES

(71) Applicant: Hyperloop Technologies, Inc., Los Angeles, CA (US)

(72) Inventors: James T. Coutre, Los Angeles, CA (US); Casey Handmer, S Pasadena, CA (US); Brogan Bambrogan, Los Angeles, CA (US); Joshua Giegel, Hawthorne, CA (US); Filip Finodeyev, Laguna Niguel, CA (US)

(73) Assignee: HYPERLOOP TECHNOLOGIES, INC., Los Angeles, CA (US)

( * ) Notice: Subject to any disclaimer, the term of this patent is extended or adjusted under 35 U.S.C. 154(b) by 0 days.

(21) Appl. No.: 15/008,017

(22) Filed: Jan. 27, 2016

(65) Prior Publication Data

US 2016/0229420 A1 Aug. 11, 2016

Related U.S. Application Data

(60) Provisional application No. 62/234,226, filed on Sep. 29, 2015, provisional application No. 62/113,511, filed on Feb. 8, 2015.

(51) Int. Cl.
*B61B 13/00* (2006.01)
*B61B 13/10* (2006.01)
*E02D 29/063* (2006.01)

(52) U.S. Cl.
CPC ..... *B61B 13/10* (2013.01); *E02D 29/063* (2013.01)

(58) Field of Classification Search
CPC ..... B61B 13/10; F16K 3/30; F16K 3/03; F16K 3/12; H02P 3/04; H02P 6/00; H02P 25/06; B60L 5/00; B60L 13/00; B60L 15/00
USPC ..... 104/138.1, 138.2, 140
See application file for complete search history.

(56) References Cited

U.S. PATENT DOCUMENTS

| | | | |
|---|---|---|---|
| 131,322 | A | 9/1872 | Anderson |
| 2,296,771 | A | 9/1942 | Crawford et al. |
| 2,488,287 | A | 11/1949 | Goddard |
| 2,511,979 | A | 6/1950 | Goddard |
| 2,791,633 | A | 9/1956 | Sindzinski |

(Continued)

FOREIGN PATENT DOCUMENTS

| | | |
|---|---|---|
| EP | 2371613 | 10/2011 |
| WO | WO03/002370 A1 | 1/2003 |

(Continued)

OTHER PUBLICATIONS

U.S. Appl. No. 15/007,783, entitled "Transportation System."

(Continued)

*Primary Examiner* — Jason C Smith
(74) *Attorney, Agent, or Firm* — Greenblum & Bernstein, P.L.C.

(57) ABSTRACT

A high-speed transportation system, the system having at least one enclosed volume that is configured to be maintained as a low-pressure environment, at least one track along a transportation path within the at least enclosed volume; and a plurality of capsules configured for travel through the at least one enclosed volume between stations. The at least one enclosed volume is at least partially defined by at least one flexible material structured and arranged to withstand a tensile load.

26 Claims, 22 Drawing Sheets

(56) References Cited

U.S. PATENT DOCUMENTS 2,956,823 A 10/1960 Benjamin, Jr. et al.
3,006,288 A 10/1961 Brown
3,083,528 A 4/1963 Brown
3,100,454 A 8/1963 Dennis
3,132,416 A 5/1964 Hait
3,233,559 A 2/1966 Smith et al.
3,605,629 A 9/1971 Edwards
3,610,163 A 10/1971 Edwards
3,738,281 A 6/1973 Waidelich
3,750,803 A 8/1973 Paxton
3,768,417 A 10/1973 Thornton et al.
3,776,141 A 12/1973 Gelhard et al.
3,854,411 A 12/1974 Lichtenberg
3,952,667 A 4/1976 Kovanov et al.
3,954,064 A 5/1976 Minovitch
4,015,540 A 4/1977 Roxberry
4,023,500 A * 5/1977 Diggs ..... B65G 51/04 104/138.1
4,075,948 A 2/1978 Minovitch
4,108,077 A 8/1978 Laing
4,148,260 A 4/1979 Minovitch
4,175,414 A 11/1979 Peytavin
4,202,272 A 5/1980 Teodorescu et al.
4,400,655 A 8/1983 Curtiss et al.
4,427,740 A 1/1984 Stackhouse et al.
4,676,295 A 6/1987 Samuelson
4,718,459 A 1/1988 Adorjan
4,881,469 A * 11/1989 Hirtz ..... E01B 25/12 104/138.1
5,282,424 A 2/1994 O'Neill
5,388,527 A 2/1995 Thornton et al.
5,619,930 A 4/1997 Alimanestiano
5,899,635 A 5/1999 Kuja et al.
5,950,543 A 9/1999 Oster
6,178,892 B1 * 1/2001 Harding ..... B60V 3/04 104/119
6,279,485 B1 * 8/2001 Schlienger ..... B60V 3/04 104/138.1
6,311,476 B1 11/2001 Frye et al.
6,373,153 B1 4/2002 Hazelton et al.
6,374,746 B1 4/2002 Fiske
6,418,857 B1 7/2002 Okano et al.
6,502,517 B1 1/2003 Groening et al.
6,684,794 B2 2/2004 Fiske et al.
7,114,882 B1 * 10/2006 Friedmann ..... E02D 27/50 405/194
7,835,830 B2 11/2010 Ellmann et al.
7,841,564 B2 11/2010 Ellmann et al.
8,006,625 B2 8/2011 Yang
8,214,957 B2 7/2012 Miettinen
8,250,990 B2 8/2012 Kunz
8,281,723 B2 10/2012 Loeser et al.
8,297,195 B2 10/2012 Loser et al.
8,468,949 B2 * 6/2013 Kwon ..... B61B 13/08 104/155
8,500,373 B1 8/2013 Epps
8,534,197 B2 9/2013 Miller
8,734,139 B2 5/2014 Burns et al.
8,915,192 B2 12/2014 Zhou
9,085,304 B2 7/2015 Oster
9,228,298 B2 1/2016 Oster
9,290,187 B2 3/2016 Dalrymple
9,302,577 B2 4/2016 Catalan
2001/0037747 A1 11/2001 Svensson
2002/0197135 A1 12/2002 Arntzen et al.
2004/0056538 A1 3/2004 Du et al.
2004/0139723 A1 7/2004 Parkin
2004/0144096 A1 7/2004 Wollenweber
2004/0155031 A1 8/2004 Toyooka et al.
2005/0076802 A1 4/2005 Pulliam
2006/0032063 A1 2/2006 Tomasello et al.
2006/0091347 A1 * 5/2006 McGuire ..... F16K 3/0236 251/326
2006/0150858 A1 * 7/2006 Appleton ..... F16L 55/34 104/138.1
2006/0233616 A1 * 10/2006 Friedmann ..... E02D 27/50 405/224
2006/0235589 A1 10/2006 Deng et al.
2007/0187556 A1 8/2007 Yoshitake
2007/0214994 A1 * 9/2007 Ardente ..... B62D 61/06 104/138.1
2008/0275572 A1 11/2008 Tillotson
2008/0277534 A1 11/2008 Ellmann et al.
2009/0101040 A1 * 4/2009 Yang ..... B61B 13/10 104/138.1
2009/0158955 A1 6/2009 Pulliam
2010/0005997 A1 1/2010 Tozoni
2010/0083864 A1 * 4/2010 Flynn ..... B61B 13/10 104/138.1
2010/0092243 A1 4/2010 Bauder
2010/0115947 A1 5/2010 Galbraith
2010/0143044 A1 6/2010 Kadaster et al.
2010/0183407 A1 7/2010 Kim
2010/0192799 A1 * 8/2010 Miller ..... B60L 13/04 104/138.1
2011/0042592 A1 * 2/2011 Elliott ..... F16K 47/08 251/120
2011/0226151 A1 * 9/2011 Pumpelly ..... B60L 11/00 104/118
2011/0226764 A1 9/2011 Smith et al.
2011/0283914 A1 11/2011 Kwon et al.
2012/0089525 A1 4/2012 Kley et al.
2012/0153744 A1 6/2012 Criswell et al.
2012/0285575 A1 11/2012 Catha
2012/0299684 A1 11/2012 Won
2013/0025493 A1 * 1/2013 Friedmann ..... B60L 13/04 104/138.1
2013/0125779 A1 * 5/2013 De Matias Jimenez .. B61B 1/00 104/138.1
2013/0136546 A1 * 5/2013 Friedmann ..... B60L 13/04 406/181
2013/0276665 A1 10/2013 Dalrymple
2014/0000473 A1 1/2014 Miller
2014/0261054 A1 * 9/2014 Oster ..... E01B 25/34 104/130.02
2014/0261055 A1 9/2014 Oster
2014/0354064 A1 12/2014 Tseliakhovich

FOREIGN PATENT DOCUMENTS

WO WO03/003389 A1 1/2003
WO WO2007/087028 A2 8/2007
WO WO2009/135389 11/2009

OTHER PUBLICATIONS

U.S. Appl. No. 15/007,882, entitled "Transportation System."
U.S. Appl. No. 15/007,829, entitled "Transportation System."
U.S. Appl. No. 15/007,452, entitled "Transportation System."
U.S. Appl. No. 15/007,883, entitled "Transportation System."
U.S. Appl. No. 15/007,993, entitled "Transportation System."
U.S. Appl. No. 15/007,712, entitled "Gate Valves and Airlocks for a Transportation System."
U.S. Appl. No. 15/008,017, entitled "Low-Pressure Environment Structures."
U.S. Appl. No. 15/007,940, entitled "Continuous Winding for Electric Motors."
U.S. Appl. No. 15/007,745, entitled "Expansion Joints, Dampers, Control Systems for a Tubular Transportation Structure Stability System."
U.S. Appl. No. 15/007,801, entitled "Axial Compressor Configuration."
U.S. Appl. No. 15/007,974, entitled "Power Supply System and Method for a Moveable Vehicle Within a Structure."
U.S. Appl. No. 15/008,024, entitled "Dynamic Linear Stator Segment Control"
U.S. Appl. No. 15/007,718, entitled "Deployable Decelerator."
Musk, E., "Hyperloop White Paper," dated Aug. 12, 2013.

(56) References Cited

OTHER PUBLICATIONS

Wright, I., "Engineering the Hyperloop: Testing 4 Core Elements," dated Feb. 16, 2016.
Protalinski, E., "Hyperloop's intro video claims the future is now," dated Sep. 17, 2015.
GNB Corporation Product Catalog, 20 pages, (Mar. 14, 2013).
Khatait, J., et al., "Design and development of orifice-type aerostatic thrust bearing," SIMTech technical reports, vol. 6, No. 1 (Jan. 2005).
Barsikow, B., et al., "Noise Characteristics of the Transrapid TRO8 Maglev System," US Department of Transportation, 338 pages (Jul. 2002).
Brecher, A., et al., "Electromagnetic Field Characteristics of the Transrapid TR08 Maglev System," US Department of Transportation, 224 pages (May 2002).
Chan, L., et al., "Vibration Characteristics of the Transrapid TR08 Maglev System," US Department of Transportation, 143 pages (Mar. 2002).
Todorovich et al., "High-Speed Rail—International Lessons for U.S. Policy Makers," Lincoln Institute of Land Policy, 64 pages (2011).
Peterman, D., et al., "The Development of High Speed Rail in the United States: Issues and Recent Events," Congressional Research Service, 35 pages (Dec. 20, 2013).
International Search Report and Written Opinion of International Searching Authority for related Application No. PCT/US2016/015231, dated Mar. 25, 2016.
International Search Report and Written Opinion of International Searching Authority for related Application No. PCT/US16/15228, dated Apr. 8, 2016.
International Search Report and Written Opinion of International Searching Authority for related Application No. PCT/US16/15215, dated Apr. 8, 2016.
International Search Report and Written Opinion of International Searching Authority for related Application No. PCT/US2016/015234, dated Apr. 4, 2016.
Barboza, D., "A New Port in Shanghai, 20 Miles Out to Sea," The New York Times, Dec. 12, 2005.
International Search Report and Written Opinion of International Searching Authority for related Application No. PCT/US2016/015221, dated Mar. 31, 2016.
International Search Report and Written Opinion of International Searching Authority for related Application No. PCT/US2016/015224, dated Apr. 11, 2016.
International Search Report and Written Opinion of International Searching Authority for related Application No. PCT/US2016/015229, dated Apr. 4, 2016.
Thornton. R., "The Future of Maglev," Magnemotion, Nov. 5, 2007.
International Search Report and Written Opinion of International Searching Authority for related Application No. PCT/US2016/015206, dated Apr. 1, 2016.
International Search Report and Written Opinion of International Searching Authority for related Application No. PCT/US2016/015236, dated Mar. 29, 2016.
International Search Report and Written Opinion of International Searching Authority for related Application No. PCT/US2016/015238, dated Apr. 1, 2016.
International Search Report and Written Opinion of International Searching Authority for related Application No. PCT/US2016/015239, dated Mar. 30, 2016.
Stephenson, N., Excerpt from "Seveneves: A Novel," and "Seveneves" Wikipedia Article, 9 pages (May 19, 2015).

* cited by examiner

LOW-PRESSURE ENVIRONMENT STRUCTURES

CROSS REFERENCE TO RELATED APPLICATIONS

The present application claims the benefit of U.S. Provisional Application No. 62/113,511 filed on Feb. 8, 2015, and U.S. Provisional Application No. 62/234,226 filed on Sep. 29, 2015, the disclosures of which are expressly incorporated by reference herein in their entireties.

FIELD OF THE DISCLOSURE

The present disclosure relates to low-pressure environment structures for a high-speed transportation system, and methods of use thereof.

BACKGROUND OF THE DISCLOSURE

Traditional transportation modes via water, land, rail and air revolutionized the movement and growth of our current culture. Adverse environmental, societal, and economic impacts of these traditional transportation models, however, initiated a movement to find alternative transportation modes that take advantage of the significant improvements in transportation technology and efficiently move people and materials between locations. High-speed transportation systems utilizing rails or other structural guidance components have been contemplated as a solution to existing transportation challenges while improving safety, decreasing the environmental impact of traditional transportation modes and reducing the overall time commuting between major metropolitan communities.

A high speed, high efficiency transportation system utilizes a low-pressure environment in order to reduce drag on a vehicle at high operating speeds, thus providing the dual benefit of allowing greater speed potential and lowering the energy costs associated with overcoming drag forces. In embodiments, these systems may use a near vacuum (e.g., low-pressure) environment within a tubular structure.

Tube structures for low-pressure environments, however, may have some drawbacks, including material and manufacturing costs. Thus, there exists a need for alternative structures to the tube for low-pressure environments.

SUMMARY OF THE EMBODIMENTS OF THE DISCLOSURE

Aspects of the present disclosure are directed to a high-speed transportation system, the system comprising at least one enclosed volume that is configured to be maintained as a low-pressure environment, at least one track along a transportation path within the at least enclosed volume, and a plurality of capsules configured for travel through the at least one enclosed volume between stations. The at least one enclosed volume is at least partially defined by at least one flexible material structured and arranged to withstand a tensile load.

In embodiments, the high-speed transportation system further comprises at least one support structure configured to support the flexible material and structured and arranged to withstand a compressive load.

In further embodiments, the system additionally comprises at least one track support platform.

In additional embodiments, the at least one flexible material together with the at least one track support platform defines the at least one enclosed volume.

In some embodiments, the flexible material defines the at least one enclosed volume.

In certain embodiments, the at least one support structure comprises at least one vertical support.

In further embodiments, the at least one flexible material together with the at least one vertical support defines the at least one enclosed volume.

In additional embodiments, the at least one support structure comprises a plurality of support structures spaced along the transportation path.

In some embodiments, the at least one support structure comprises at least one angled support.

In certain embodiments, the at least one angled support is attached to a track support platform.

In further embodiments, the at least one angled support is attached to at least one vertical support.

In additional embodiments, the at least one angled support extends in a downwardly direction.

In some embodiments, the at least one angled support extends in an upwardly direction.

In certain embodiments, the at least one support structure comprises an arch structure.

In further embodiments, the high-speed transportation system further comprises a second flexible material structured and arranged to define a second enclosed volume that encloses the first enclosed volume, and which is configured to be maintained at a pressure higher than a pressure outside of the second enclosed volume.

In additional embodiments, the second enclosed volume is arranged in an under-water environment.

In some embodiments, the high-speed transportation system further comprises at least one walkway or guideway arranged within the at least one enclosed volume.

In certain embodiments, the at least one support structure comprises a plurality of support rings, and the system additionally comprises a plurality of support wires connected between two of the plurality of support rings, wherein the at least one flexible material is at least supported by the plurality of support wires.

In further embodiments, the plurality of support wires between adjacent support rings are configured with a 90° clocking.

In additional embodiments, the support wires comprise at least one of: steel, fibers, polymer materials, webbing, and filaments.

In embodiments, the tensile load is due at least in part to a pressure differential between the low-pressure environment of the enclosed volume, and an ambient pressure outside the enclosed volume.

In certain embodiments, the at least one flexible material comprises at least one of: a plastic membrane; a plastic membrane having embedded filaments; a layer of metal; a translucent material; and a transparent material.

In embodiments, the at least one flexible material is impermeable to air.

In additional embodiments, the system additionally comprises a propulsion system adapted to propel the at least one capsule through the enclosed volume; and a levitation system adapted to levitate the capsule within the enclosed volume.

Additional aspects of the present disclosure are directed to a structure, comprising at least one flexible material structured and arranged to withstand a tensile load; at least one support structure configured to support the flexible material and structured and arranged to withstand a compressive load, and at least one enclosed volume at least partially defined by the at least one flexible material, and the at least one enclosed volume being configured to be maintained as a low-pressure environment for a high-speed transportation system.

In additional embodiments, the structure further comprises at least one track along a transportation path within the at least enclosed volume, wherein the at least one track is configured for supporting a capsule configured for travel through the at least enclosed volume.

BRIEF DESCRIPTION OF THE DRAWINGS

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the system. For a more complete understanding of the disclosure, as well as other aims and further features thereof, reference may be had to the following detailed description of the disclosure in conjunction with the following exemplary and non-limiting drawings wherein.

DETAILED DISCLOSURE

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions (unless otherwise explicitly indicated).

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

The various embodiments disclosed herein can be used separately and in various combinations unless specifically stated to the contrary.

Figure 1:
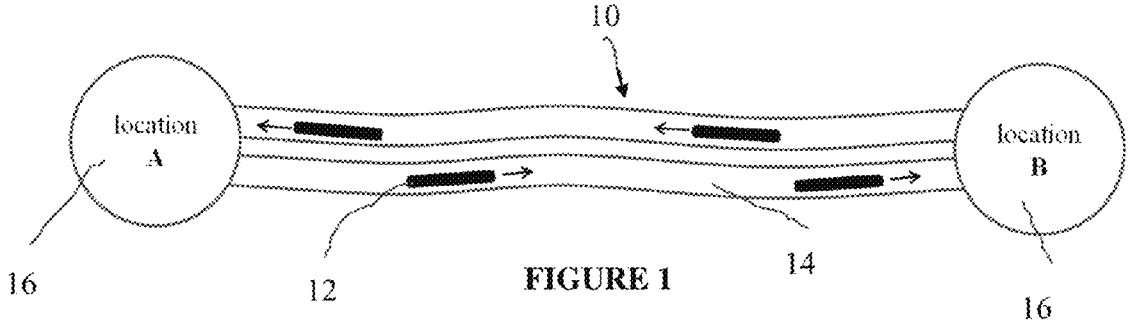
FIG. 1 is a schematic view of a transportation system in accordance with embodiments of the present disclosure.

Referring to FIG. 1, a transportation system 10 in accordance with aspects of the present disclosure is illustrated. In embodiments, the transportation system 10 comprises one or more capsules or transport pods 12 traveling through at least one enclosed structure (e.g., a tube) 14 between two or more stations 16. In one exemplary embodiment of the present disclosure, the capsules 12 of the transportation system 10 move through a low-pressure environment within the at least one enclosed structure 14. In accordance with certain aspects of the disclosure, a low-pressure environment includes (but is not limited to) any pressure that is below 1 atmosphere (or approximately 1 bar) at sea level.

Some elements of a high-speed transportation system are discussed in commonly-assigned U.S. application Ser. No. 15/007,783, entitled "Transportation System," filed in the USPTO on even date herewith, the entire content of which is expressly incorporated by reference herein in its entirety.

In embodiments of the present disclosure, a system comprises one or more partially evacuated enclosed structures 14 that connect the stations 16 in a closed loop system. In embodiments, enclosed structures 14 may be sized for optimal air flow around the capsule 12 to improve performance and energy consumption efficiency at the expected or design travel speed. In accordance with aspects of the disclosure, the low-pressure environment in the enclosed structures 14 minimizes the drag force on the capsule 12, while maintaining the relative ease of pumping out the air from the tubes.

Figure 2:
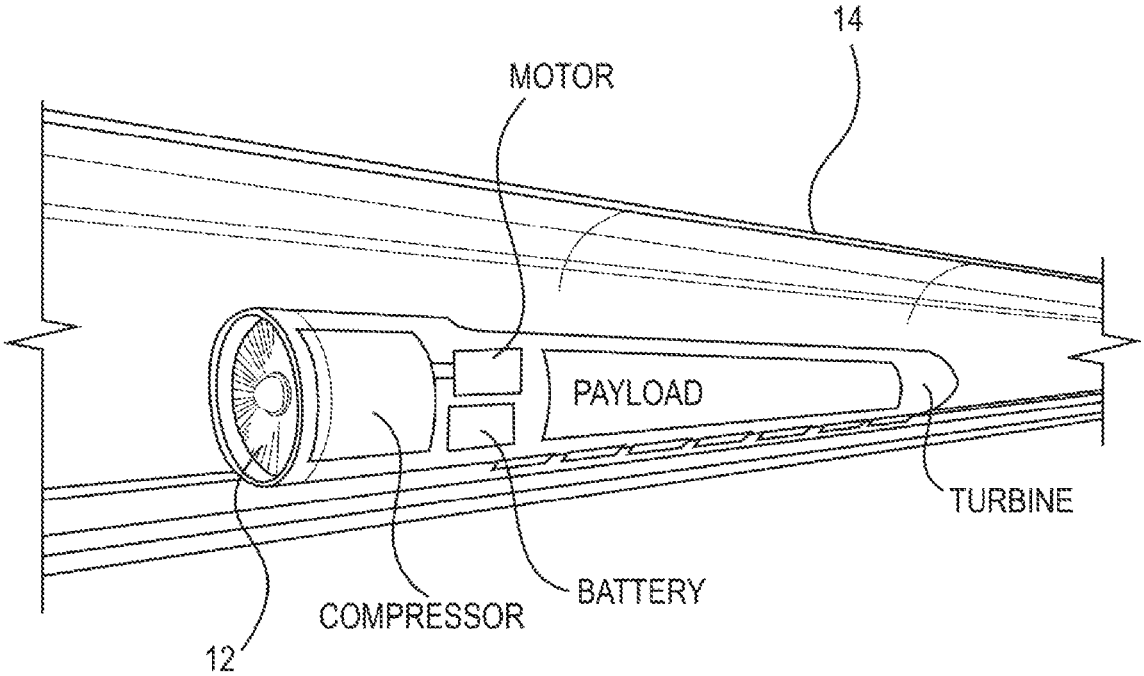
FIG. 2 illustrates a view of exemplary capsule for use in the transportation system in accordance with embodiments of the present disclosure.

Referring now to FIG. 2, an exemplary and non-limiting depiction of a capsule or transport pod 12 of the transportation system is illustrated. In embodiments, the capsule 12 may be streamlined to reduce an air drag coefficient as the capsule 12 travels through the low-pressure environment of the at least one enclosed structure 14 of the transportation system. In accordance with aspects of the disclosure, in certain embodiments, a compressor arranged at the front end of the capsule is operable to ingest at least a portion of the incoming air and pass it through the capsule (instead of displacing the air around the vehicle). For example, as schematically shown in the exemplary embodiment of FIG. 2, the capsule 12 may include a compressor at its leading face. In embodiments, the compressor is operable to ingest oncoming air and utilize the compressed air for the levitation process (when, for example, the capsules are supported via air bearings that operate using a compressed air reservoir and aerodynamic lift). Additionally, as schematically shown in the exemplary embodiment of FIG. 2, in embodiments, the compressed air may be used to spin a turbine, for example, located at the rear end of the capsule, to provide power to the capsule 12. As schematically shown in the exemplary embodiment of FIG. 2, the capsule 12 may also include a motor structured and arranged to drive the compressor, and a battery for storing energy, e.g., derived from the turbine. The capsule 12 also includes a payload area, which may be configured for humans, for cargo, and/or for both humans and cargo.

When the enclosed structure that forms the channel for the transit or transportation corridor is a tube structure, the tube structure operates under heavy compression due to the difference in pressure between the near-vacuum inside of tube and the atmospheric pressure outside the walls of the tube. This loading can cause the cylinder walls to buckle. Therefore, the tube structure design may not be limited by strength of materials, but rather by shell thickness, geometry modifications, and material stiffness properties. The tube thickness may require increased thickness or a more complex geometry than it would if the structure were strength-limited only, and so the cost increases for this component of the transportation system. Since a very large fraction of the transportation system cost is in the enclosed structure materials and construction, it is important to optimize the efficiency and cost of this structure to as great an extent as possible.

In accordance with aspects of the disclosure, the tube structure can be replaced with alternative structures, such as an enclosed structure for containing low-pressure environments that is structured and arranged to withstand the pressure load in tension (at least partially). A structure in pure tension cannot buckle, and therefore can often be taken to a higher stress state than a structure loaded primarily in compression. Thus, in accordance with aspects of the disclosure, utilizing a tension-loaded structure allows for more efficient use of the material. By utilizing material efficiently (that is, by utilizing a higher fraction of the material allowable stress) and loading each structural element to be strength-limited, as opposed to buckling-limited (which may require more material e.g., greater thickness), the amount of construction material may be reduced. This reduction in material may result in a substantial reduction in cost.

In accordance with aspects of the disclosure, in embodiments, a thin membrane material is exposed to the pressure differential and shaped (e.g., using a support structure) specifically to act in tension. This membrane is supported continuously or discretely at increments by compression (e.g., primarily in compression) structures that determine the shape of the membrane and keep the membrane from collapsing under load. Embodiments of the present disclosure may comprise a material (e.g., a small amount of thin material) to provide the pressure barrier, and a support structure (that withstands the compression loads directly) supporting the pressure barrier. By implementing aspects of the disclosure, these low-pressure environment structures can avoid the problem of buckling (or higher material costs) that may be experienced with tubular structures.

Figure 3:
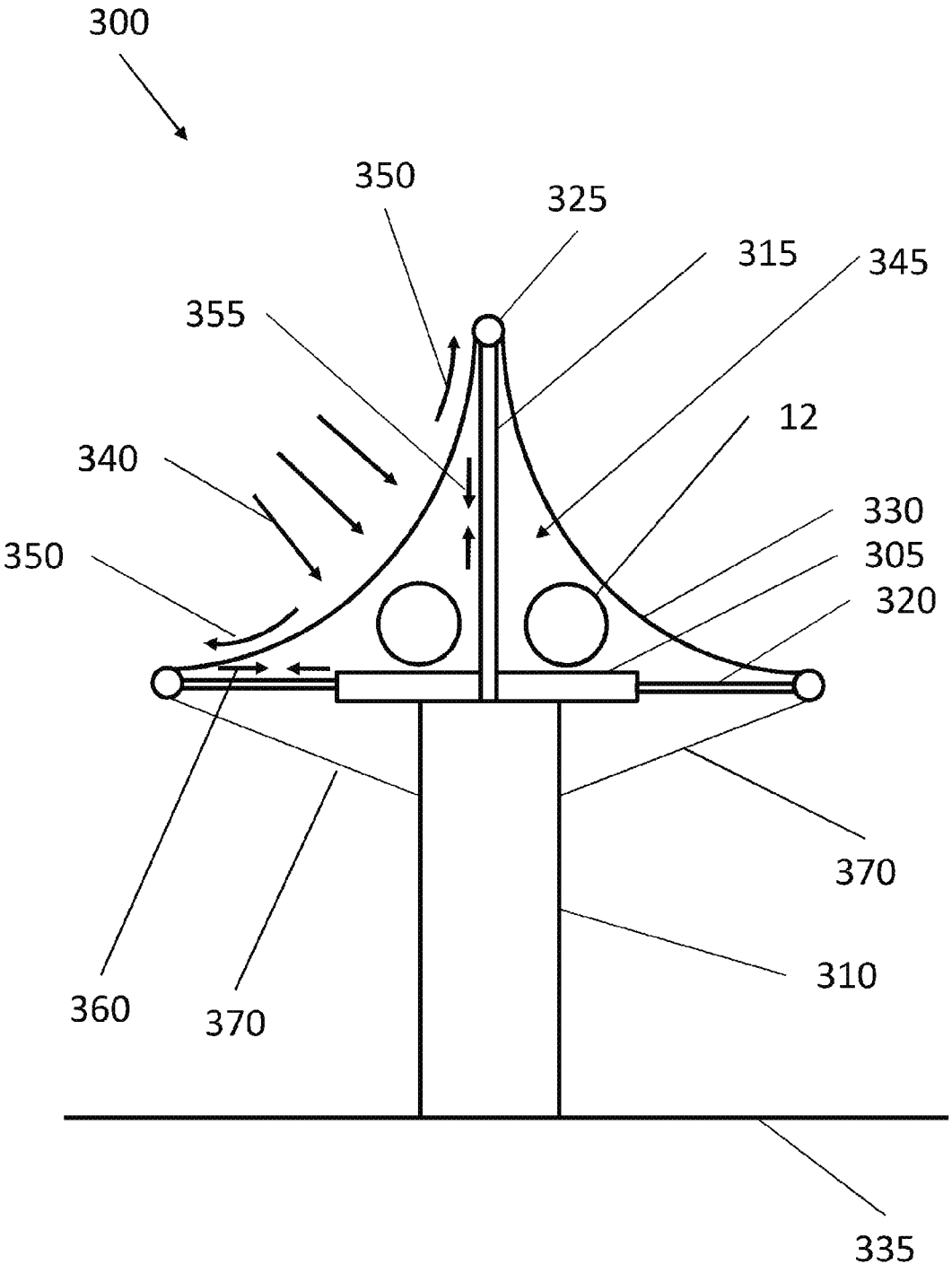
FIG. 3 illustrates a schematic view of an exemplary low-pressure environment structure in accordance with embodiments of the present disclosure.

FIG. 3 illustrates a schematic view of an exemplary low-pressure environment structure 300 in accordance with embodiments of the present disclosure. As shown in FIG. 3, the structure 300 includes at least one track support platform 305 for supporting at least one track configured for capsules 12 traveling through the transportation system. In embodiments, the at least one track support platform 305 may be supported on at least one pillar 310 in contact with the ground 335. A vertical support 315 is arranged on (or between) the at least track support platform 305, and includes an attachment structure 325 at the top thereof. As shown in FIG. 3, two horizontal supports 320 extend approximately horizontally from the track support platform 305, and each includes an attachment structure 325 at a respective end thereof. Cables 370 may be connected to respective attachment structures 325 and the pillar 310 and in tension to counter loading from below the track support platform 305 and horizontal supports 320 by atmospheric pressure. The vertical support 315 and the two horizontal supports 320 may be arranged approximately regularly-spaced along the path of the transportation system (e.g., approximately every 100-150 feet).

In accordance with aspects of the disclosure, as shown in FIG. 3, at least one sheet of flexible material 330 (or a membrane) is attached between the attachment structures 325 to create an enclosed environment 345. The flexible material 330 is held in tension between respective attachment structures 325 and is structured and configured to support a tension load. In embodiments, the attachment structures 325 may comprise, for example, hooks, loops, fasteners, and/or adhesives. In some embodiments (not shown), instead of (or in addition to) the cable 370, the membrane (or flexible material) 330 may continue wrapping around until it reaches the base of the pylon that supports the track.

When air is evacuated in the enclosed environment 345 (e.g., to create the low-pressure environment), a pressure differential will exist between the outside environment and the enclosed environment 345, wherein the pressure inside the enclosed environment 345 (e.g., less than 1 atmosphere) will be lower than the outside ambient pressure (e.g., 1 atmosphere). Accordingly, due to the pressure differential, forces 340 will act on the flexible material 330 causing a tension 350 in the flexible material 330. In accordance with aspects of the disclosure, the flexible material 330 is structured and arranged to withstand the tension. Moreover, as the flexible material 330 is subjected to a tensile load 350 (rather than a compressive load) the flexible material 330 can withstand the load while utilizing less material.

As shown in FIG. 3, the tension (represented by arrow 350) in the flexible material 330 (as well as the weight of the structure) induces a compressive load (represented by arrow 355) in the vertical support 315 and/or compressive loads (represented by arrow 360) in each of the two horizontal supports 320. Within the context of the present application, while some elements are described as being in compression, it should be understood that these structures may be primarily in compression (with some tension as well). In accordance with further aspects of the disclosure, the vertical support 315 and the two horizontal supports 320 are structured and configured to withstand these compressive loads 355, 360 directly.

In such a manner, in accordance with aspects of the disclosure, an alternative structure to the tubular structure may be utilized in the high-speed transportation system, which alternative structure may be less expensive to manufacture and install. By utilizing such an alternative structure, the overall costs for the transportation system may be reduced.

In embodiments, the flexible material 330 may comprise a thin plastic film layered around high strength filaments, e.g., Kevlar or carbon fiber. In accordance with aspects of the disclosure, utilizing these filaments in such a structure improves the strength and load path of the material and allows the filaments to remain thin, while accommodating and/or allowing larger radiuses of curvature with potentially larger spans between areas of support and thinner overall membrane than an unreinforced film. In accordance with aspects of the disclosure, in some embodiments, the fibers may also act as tear stops and prevent a breach in the flexible material 330 from spreading. In further contemplated embodiments, the flexible material 330 may comprise a relatively thin layer of metal (e.g., steel). Further embodiments may utilize a flexible material 330 comprising pre-manufactured sail materials. It should be understood that flexible material may include materials not generally considered flexible. For example, further embodiments may utilize a thin piece of glass or a carbon fiber sheet that is thin so as to take the appropriate curvatures and/or shapes.

In embodiments, the vertical and horizontal supports may comprise steel, reinforced concrete, and/or composite materials, for example. In accordance with aspects of the disclosure, as shown in FIG. 3, the structure 300 is symmetrical, which provides a more balanced structure.

In embodiments, the flexible material 330 may be transparent or translucent, which, for example, allows ambient light to enter the enclosed environment 345. In accordance with aspects of the disclosure, when the flexible material 330 is transparent or translucent, viewers outside of the enclosed environment 345 may be able to observe passing capsules 12 in the transportation system. Additionally, in some embodiments, the capsule 12 may have windows, which, when the flexible material 330 is transparent or translucent, provides passengers in the capsule 12 a view of the outside environment.

Figure 4:
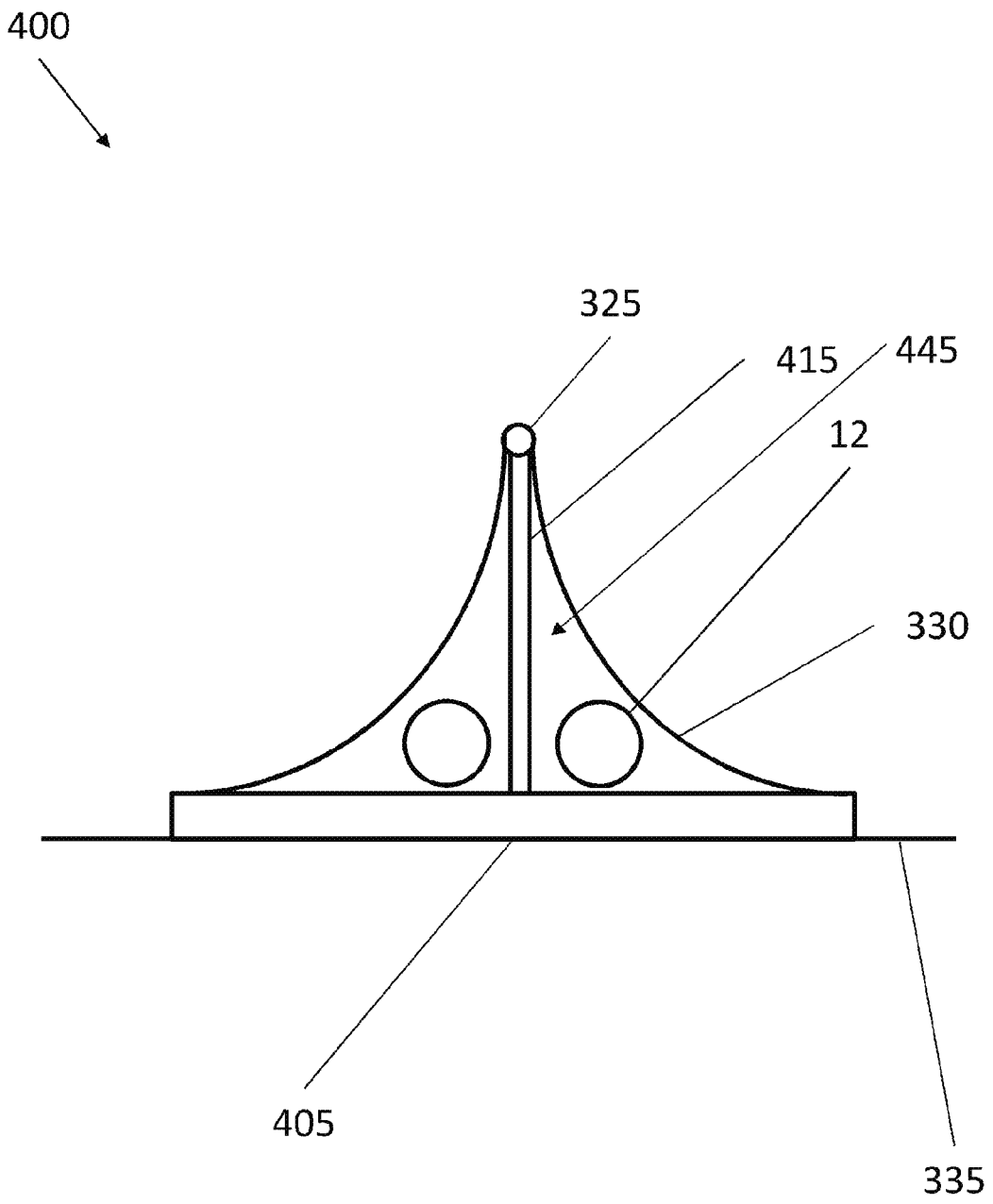
FIG. 4 illustrates a schematic view of an exemplary low-pressure environment structure in accordance with embodiments of the present disclosure.

FIG. 4 illustrates a schematic view of an exemplary low-pressure environment structure 400 in accordance with embodiments of the present disclosure. As shown in FIG. 4, with this exemplary structure 400, at least one track support platform 405 is arranged on the ground 335. A vertical support 415 is arranged on the at least one track support platform 405 (or, for example, between two track support platforms), and includes an attachment structure 325 at the top thereof. In accordance with aspects of the disclosure, as shown in FIG. 4, at least one sheet of flexible material 330 (or a membrane) is attached between attachment structure 325 and respective ends of the track support platform 405 to create an enclosed environment 445 having a transportation path for at least one capsule 12. A sealing layer (i.e., a gas impermeable layer) may be utilized to prevent air from permeating through the support platform 405. The flexible material 430 is held in tension between the attachment structure and the respective ends of the track platform 405.

Figure 5:
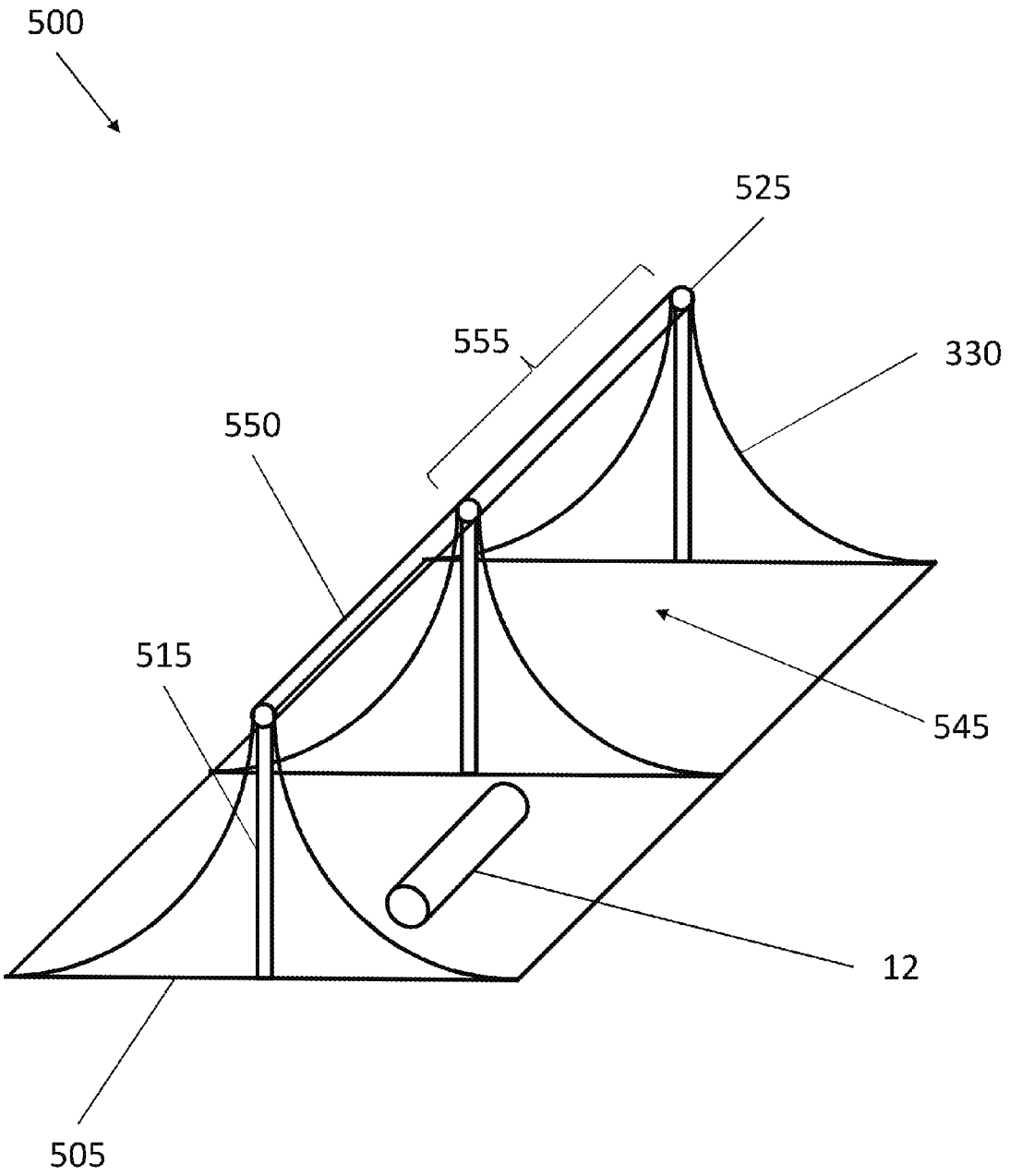
FIG. 5 illustrates a schematic perspective view of an exemplary low-pressure environment structure in accordance with embodiments of the present disclosure.

FIG. 5 illustrates a schematic perspective view of an exemplary low-pressure environment structure 500 in accordance with embodiments of the present disclosure. As shown in FIG. 5, with this exemplary structure 500, at least one track support platform 505 is arranged on the ground (not shown) or a plurality of spaced supports (not shown). A vertical support 515 is arranged on (or between) the at least one track platform 505, and includes an attachment structure 525 at the top thereof. With this exemplary structure 500, longitudinal supports 550 are arranged between and connected to the vertical supports 515 (or the attachment structures 525 on the vertical supports 515). In accordance with aspects of the disclosure, the longitudinal supports 550 are configured to increase the structural stability of the transportation structure. In embodiments, the longitudinal supports 550 may be configured to flex to account for any relative movements of the vertical supports 515. In further embodiments, the longitudinal supports 550 may include one or more expansion joints to, for example, account for any relative movements of the vertical supports 515 (e.g., due to thermal expansion and/or contraction, seismic events, and/or weather). In embodiments, the longitudinal supports 550 may be support beams, e.g., I-beams. In further contemplated embodiments, the longitudinal supports 550 may be fiber, cable, filament, or wire material, for example.

In accordance with aspects of the disclosure, as shown in FIG. 5, at least one sheet of flexible material 330 (or a membrane) is attached to attachment structure 525 and respective ends of the track platform 505 to create an enclosed environment 545. In embodiments, the at least one sheet of flexible material 330 may "drape" or hang over the support beams 550 (while, in certain embodiments, being connected thereto by connectors, e.g., clips) with respective ends of the flexible material 330 connected to the respective ends of the track platform 505. In further contemplated embodiments, the at least one sheet of flexible material 330 may comprise one sheet of flexible material 330 connected between the longitudinal supports 550 and a respective end of the track platform 505, and another sheet of flexible material 330 connected between the longitudinal supports 550 and the other respective end of the track platform 505. Additionally, the disclosure contemplates that a series of sheets of flexible material 330 will be connected to one another in order to create the enclosed environment 545. In embodiments, the connections between adjacent sheets of flexible material 330 may be formed with seams utilizing, e.g., stitching, welds, adhesives, and/or fasteners. As shown in the schematic depiction of FIG. 5, the vertical supports 515 may be arranged approximately regularly-spaced from each other along the path of the transportation system by a distance 555 (e.g., approximately every 100 to 150 feet with other distances contemplated by the disclosure).

Figure 6:
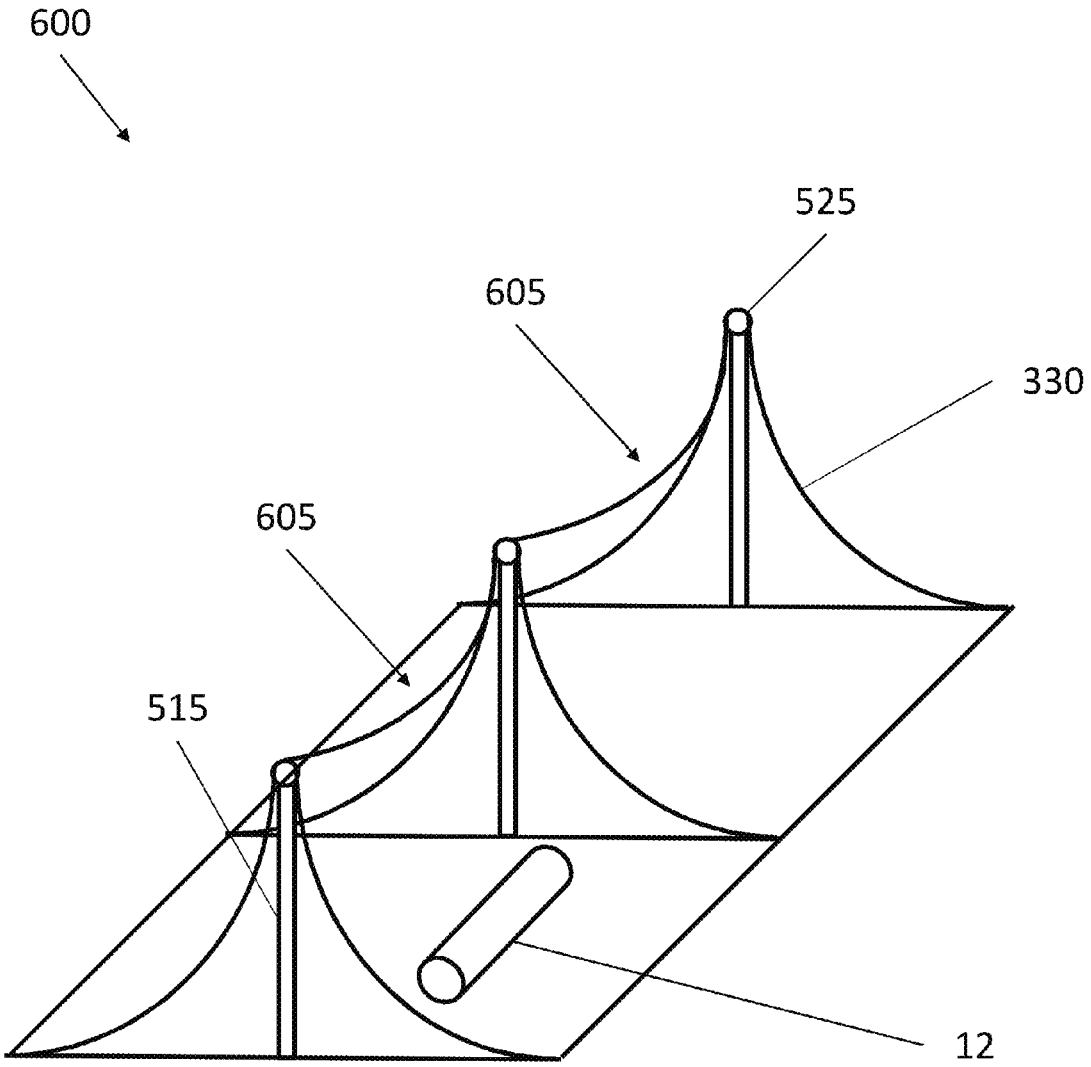
FIG. 6 illustrates a schematic perspective view of an exemplary low-pressure environment structure in accordance with embodiments of the present disclosure.

FIG. 6 illustrates a schematic perspective view of an exemplary low-pressure environment structure 600 in accordance with embodiments of the present disclosure. In contrast to the exemplary low-pressure environment structure 500 (in which the vertical supports 515 are connected by longitudinal supports 550), no longitudinal supports are provided between the spaced vertical supports 515 with structure 600. As such, as schematically depicted in FIG. 6, the sheet of flexible material 330 may have "drooping" regions 605 between spaced vertical supports 515, in a similar manner to a circus tent.

Figure 7:
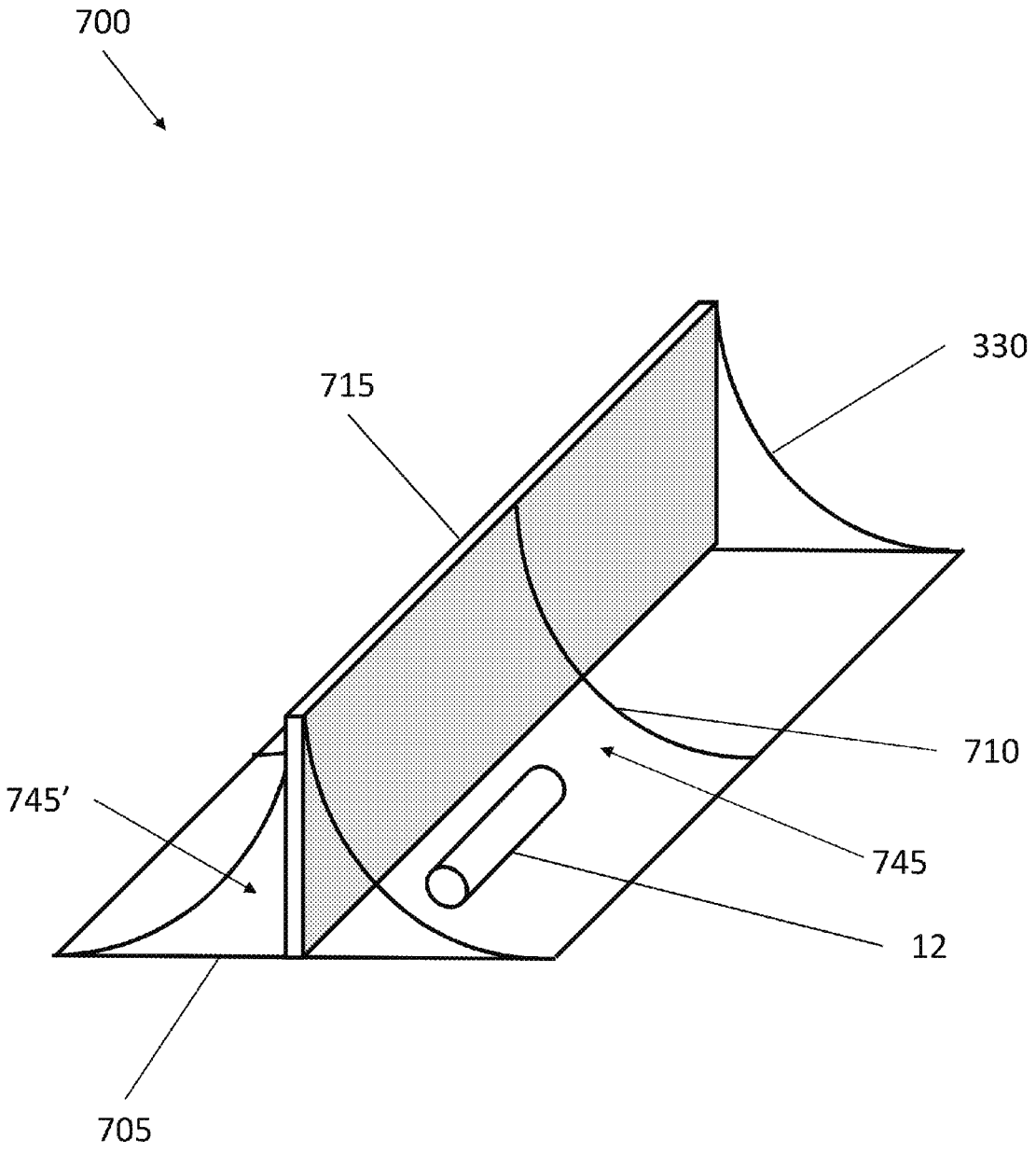
FIG. 7 illustrates a schematic perspective view of an exemplary low-pressure environment structure in accordance with embodiments of the present disclosure.

FIG. 7 illustrates a schematic perspective view of an exemplary low-pressure environment structure 700 in accordance with embodiments of the present disclosure. In contrast to the exemplary low-pressure environment structure 500 (which includes spaced vertical supports 515 with longitudinal supports 550 connected between the spaced vertical supports 515), with structure 700, at least one wall 715 is provided along the transportation path. The wall 715 is structured and configured to support the flexible material 330. In embodiments, the connections between adjacent sheets of flexible material 330 may be formed with seams 710 utilizing, e.g., stitching, welds, adhesives, and/or fasteners. With an exemplary embodiment, adjacent panels of flexible material might be joined as often as every 3"-6", which, for example, may be the width of a roll of material (e.g., a large continuous roll). In certain embodiments, seams could be arranged longitudinally and/or around the circumference of the tent profile, so there are seam joints in multiple directions for increased strength.

Additionally, in accordance with aspects of the disclosure, the at least one wall 715 may be configured to be non-permeable to air, such that when the flexible material 330 is secured to the wall 715 and the track platform 705, two enclosed environments are formed, e.g., a first enclosed environment 745 and a second enclosed environment 745'. With such a structure, if the low-pressure environment in one of the two enclosed environments is lost (e.g., due to a puncture of the flexible material 330), the low-pressure environment is still maintained in the other enclosed environment. In further aspects of the disclosure, by providing a wall 715 such that two enclosed environments are formed, e.g., a first enclosed environment 745 and a second enclosed environment 745', these two enclosed environments can be configured having different operating pressures. For example, one enclosed environment may be maintained as a low-pressure environment, and the other enclosed environment may be maintained as an atmospheric pressure environment.

While not shown in FIG. 7, in embodiments, the wall 705 may include perforations, holes, and/or windows therethrough. In accordance with aspects of the disclosure, with such a structure, the perforations, holes, and/or windows allow for air to pass from one side of the wall to the other side, which may reduce forces acting on an interior of the enclosed environment 745, for example, when two capsules 12 pass one another in the transportation system. Additionally, in accordance with aspects of the disclosure, such perforations, holes, and/or windows may reduce the overall weight of the wall 705, and thus reduce the structural requirements for other support structures (e.g., pillars, track platform) that support such wall 705.

Figure 8:
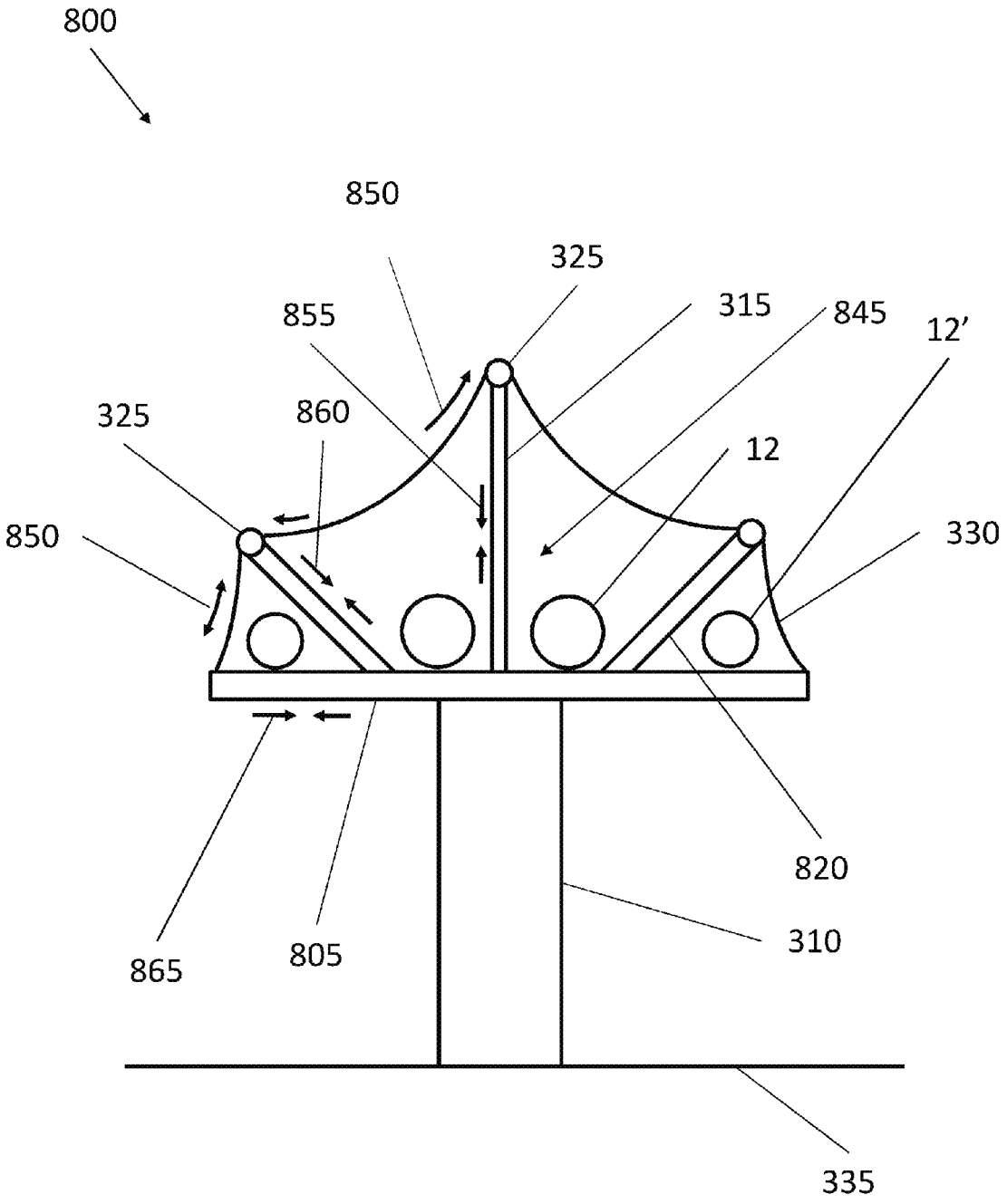
FIG. 8 illustrates a schematic view of an exemplary low-pressure environment structure in accordance with embodiments of the present disclosure.

FIG. 8 illustrates a schematic view of an exemplary low-pressure environment structure 800 in accordance with embodiments of the present disclosure. As shown in FIG. 8, the structure 800 includes at least one track support platform 805 for supporting capsules 12, 12' traveling through the transportation system. In embodiments, the at least one track support platform 805 may be supported on at least one pillar 310 in contact with the ground 335. A vertical support 315 is arranged on (or between) the at least one track support platform 805, and includes an attachment structure 325 at the top thereof. As shown in FIG. 8, two angled supports 820 extend from the track support platform 805, and each include an attachment structure 325 at the respective ends thereof. In embodiments, the vertical supports 315 and the pairs of two angled supports 820 may be arranged approximately regularly-spaced along the path of the transportation system (e.g., every 100 feet). In embodiments, cables (not shown) may be connected to respective attachment structures and the pillar 310 and in tension to counter loading from below the track support platform 805 by atmospheric pressure. In further embodiments (not shown), instead of (or in addition to) the cable, the membrane (or flexible material) 330 may continue wrapping around until it reaches the pylon (or pillar) 310 that supports the track.

In accordance with aspects of the disclosure, as shown in FIG. 8, at least one sheet of flexible material 330 (or a membrane) is attached between the attachment structures 325 and respective ends of the track support platform 805 to create an enclosed environment 845. The flexible material 330 is held in tension between respective attachment structures 325 and between the attachment structures 325 and the respective ends of the track support platform 805.

As shown in FIG. 8, in accordance with aspects of the disclosure, the tensions 850 in the flexible material 330, caused by the pressure differential between the outside environment and enclosed environment 845, induce a compressive load 855 in the vertical support 315, compressive loads 860 in each of the two angled supports 820, and compressive loads 865 in the track support platform 805. In accordance with further aspects of the disclosure, the vertical support 315, the two angled supports 820, and the track support platform 805 are structured and configured to withstand these compressive loads 855, 860, and 865. In embodiments, the angled supports 820 may comprise support beams (e.g., I-beams) or may comprise walls (e.g., with or without perforations, holes or windows).

In accordance with further aspects of the disclosure, as shown with the exemplary structure 800, four capsule paths are arranged on the track support platform 805, for example, providing paths in each direction for two types and/or sizes of capsules 12, 12'. For example, the larger capsules 12 may be configured as cargo-carrying capsules and the smaller capsules 12' may be configured as passenger-carrying capsules, or vice versa.

Figure 9:
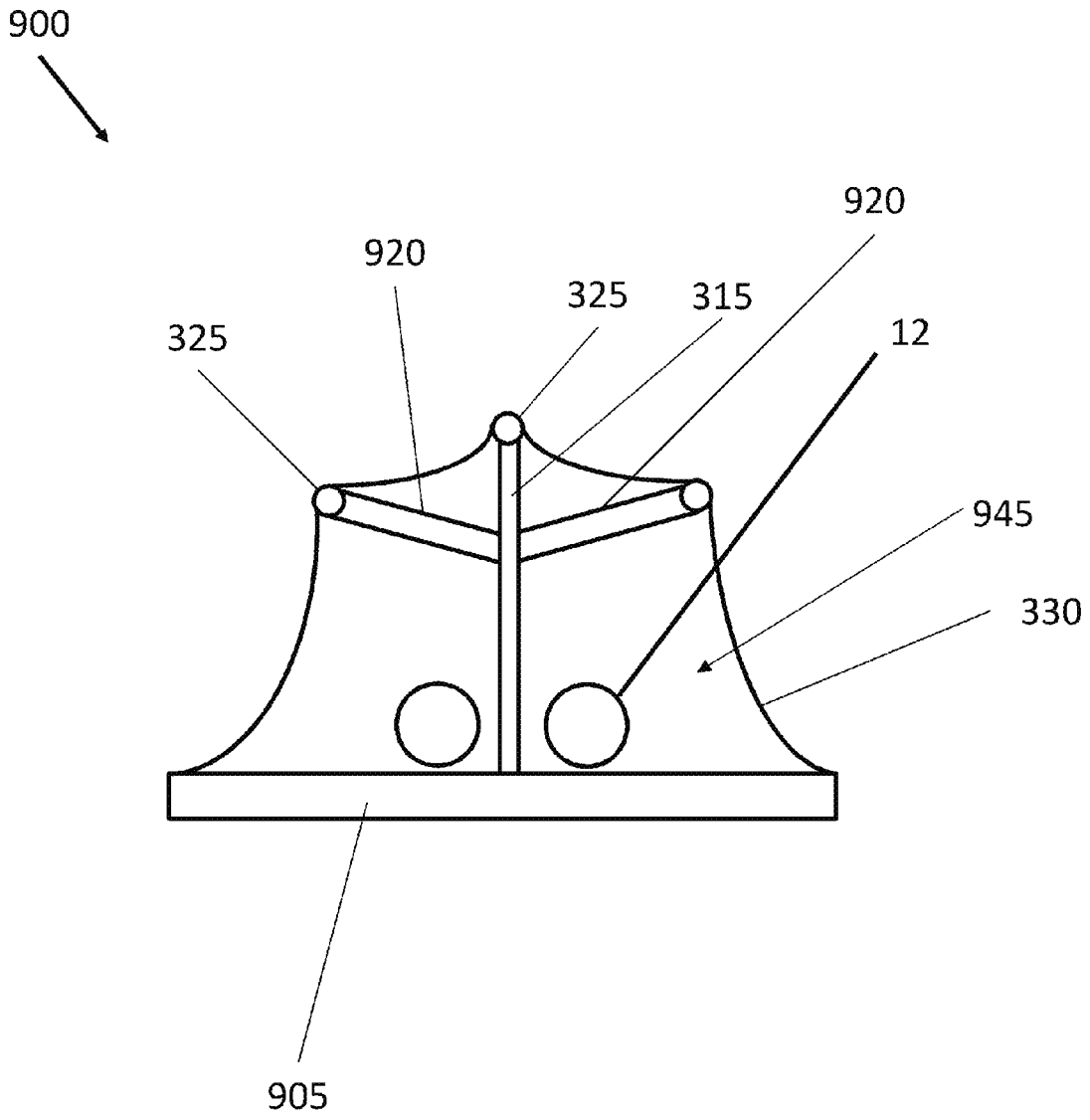
FIG. 9 illustrates a schematic view of an exemplary low-pressure environment structure in accordance with embodiments of the present disclosure.

FIG. 9 illustrates a schematic view of an exemplary low-pressure environment structure in accordance with embodiments of the present disclosure. As shown in FIG. 9, the structure 900 includes at least one track support platform 905 for supporting capsules 12 traveling through the transportation system. In embodiments, the at least one track support platform 905 may be supported on pillars (not shown) or the ground (not shown). A vertical support 315 is arranged on (or between) the at least one track support platform 905, and includes an attachment structure 325 at the top thereof. As shown in FIG. 9, two angled supports 920 extend from the vertical support 315, and each include an attachment structure 325 at the respective ends thereof. In embodiments, the vertical support 315 and the pairs of two angled supports 920 may be arranged approximately regularly-spaced along the path of the transportation system (e.g., every 100 to 150 feet).

In accordance with aspects of the disclosure, as shown in FIG. 9, at least one sheet of flexible material 330 (or a membrane) is attached between the attachment structures 325 and respective ends of the track support platform 905 to create an enclosed environment 945. The flexible material 330 is held in tension between respective attachment structures 325 and between the attachment structures 325 and the respective ends of the track support platform 905.

Figure 10:
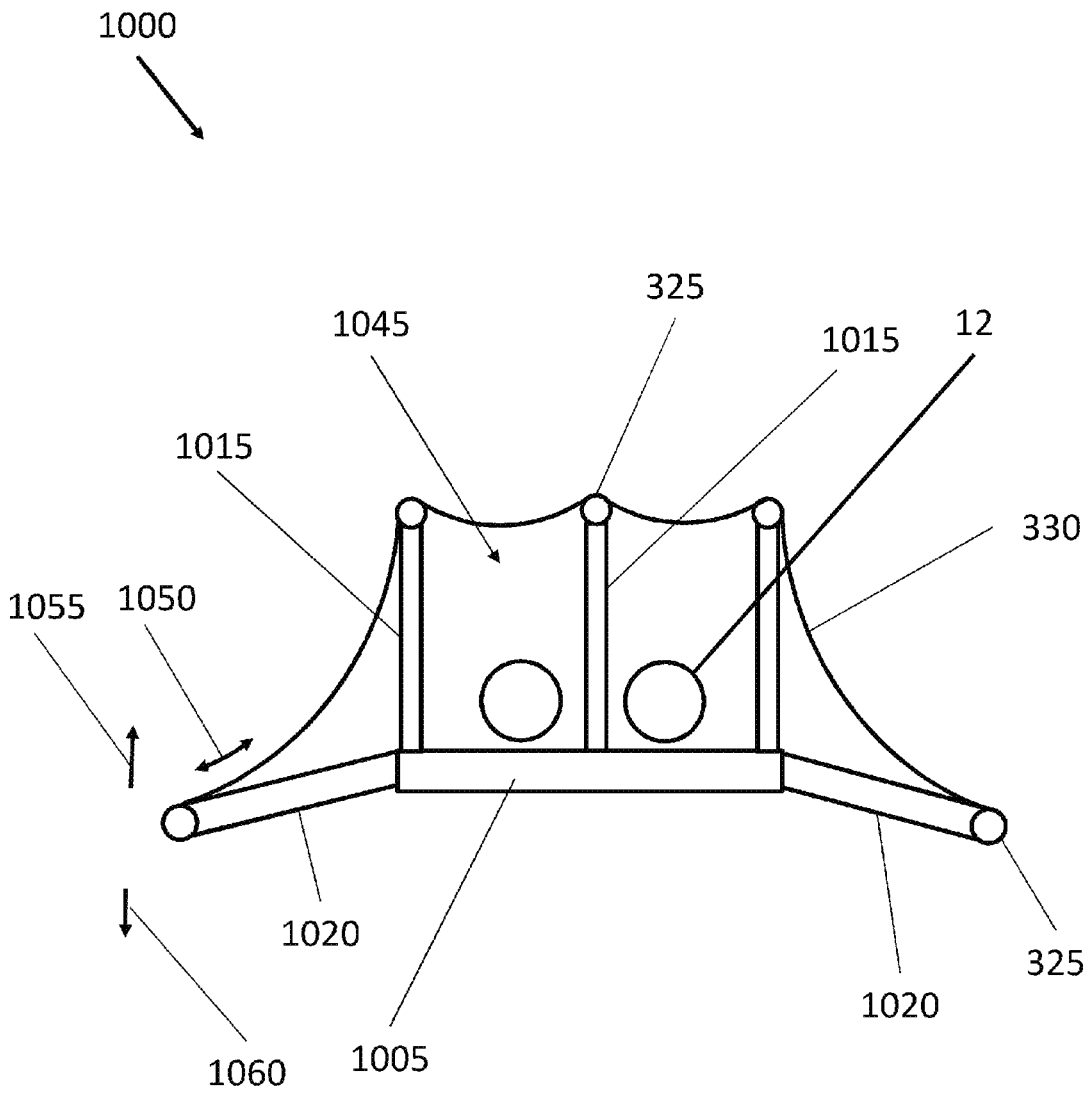
FIG. 10 illustrates a schematic view of an exemplary low-pressure environment structure in accordance with embodiments of the present disclosure.

FIG. 10 illustrates a schematic view of an exemplary low-pressure environment structure 1000 in accordance with embodiments of the present disclosure. As shown in FIG. 10, structure 1000 includes at least one track support platform 1005 for supporting capsules 12 traveling through the transportation system. In embodiments, the at least one track support platform 1005 may be supported on pillars (not shown) or the ground (not shown). With this exemplary embodiment, three vertical supports 1015 are arranged on the at least one track support platform 1005 (in the approximate middle of and on each approximate end thereof), and each include an attachment structure 325 at the tops thereof. As shown in FIG. 10, two downwardly-angled supports 1020 extend from respective ends of the track support platform 1005, and each include an attachment structure 325 at the respective ends thereof. In embodiments, the vertical support 1015 and the two angled supports 1020 may be arranged approximately regularly-spaced along the path of the transportation system (e.g., every 100 to 150 feet).

In accordance with aspects of the disclosure, as shown in FIG. 10, at least one sheet of flexible material 330 (or a membrane) is attached between the attachment structures 325 to create an enclosed environment 1045. The flexible material 330 is held in tension between respective attachment structures 325. In embodiments, cables (not shown) may be connected to respective attachment structures and the pillar (not shown) and in tension to counter loading from below the track support platform 1005 and supports 1020 by atmospheric pressure. In further embodiments (not shown), instead of (or in addition to) the cable, the membrane (or flexible material) 330 may continue wrapping around until it reaches the pylon (not shown) that supports the track.

In embodiments, tension forces 1050 in the flexible material 330 may cause an upward pull 1055 on structures to which the ends of the flexible material 330 are attached. Additionally, while this depicted embodiment utilizes vertical supports 315 that are structured and arranged to be in essentially compression only, if some supports are arranged at an upward angle (for example, as with the embodiment of FIG. 9), the exit angle of the angled supports may induce a tension (e.g., an upwardly directed tension). As shown in FIG. 10, in accordance with aspects of the disclosure, the two angled supports 1020 (which are arranged as downwardly angled) are structured and arranged to create a counter force 1060 to the upward pull 1055 caused by the tension 1050 in the flexible material 330. Such a structure may also be used to counteract an induced tension caused by upwardly angled supports (e.g., as shown in FIG. 9). Thus, in accordance with aspects of the disclosure, utilizing such downwardly-angled supports 1020 may provide a more stable and secure structure 1000.

Figure 11:
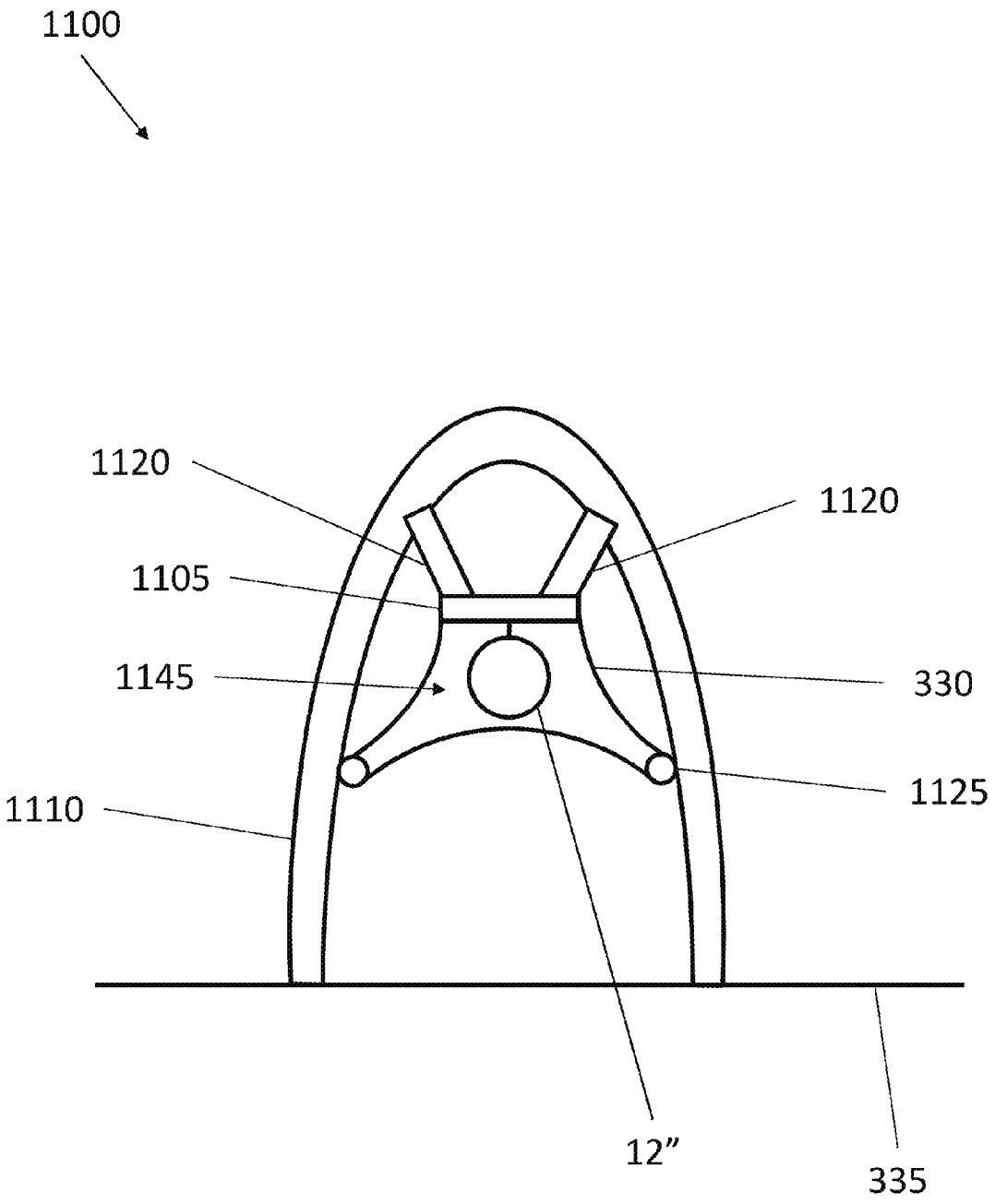
FIG. 11 illustrates a schematic view of an exemplary low-pressure environment structure in accordance with embodiments of the present disclosure.

FIG. 11 illustrates a schematic view of an exemplary low-pressure environment structure 1100 in accordance with embodiments of the present disclosure. As shown in FIG. 11, structure 1100 includes at least one track support platform 1105 for supporting capsules 12" traveling through the transportation system. In contrast to the previously discussed embodiments, with this exemplary embodiment, the capsule 12" is configured to ride along a track arranged above the capsule 12". Additionally, with this exemplary embodiment, the track support platform 1105 is configured with a single transportation path. As should be understood, the disclosure contemplates that a support platform can be configured to support, for example two transportation paths, four transportation paths, or some other number of transportation paths.

With this exemplary embodiment, the at least one track support platform 1105 (or guideway) is supported by an arch structure 1110, which is arranged on the ground 335. The arch structure 1110 is connected to depending supports 1120 (e.g., with fasteners, bolts, and/or welding), and the depending supports 1120 support the track support platform 1105 (e.g., with fasteners, bolts, brackets, and/or welding). The structure 1100 also includes lower attachment structures 1125, which may be secured to the arch structure 1110. Similarly to other embodiments, the arch structure 1110 and the two depending supports 1120 may be arranged approximately regularly-spaced along the path of the transportation system (e.g., every 100 to 150 feet). In accordance with aspects of the disclosure, as shown in FIG. 11, at least one sheet of flexible material 330 (or a membrane) is attached between the attachment structures 1125 and the ends of the track support platform 1105 to create an enclosed environment 1145.

Figure 12:
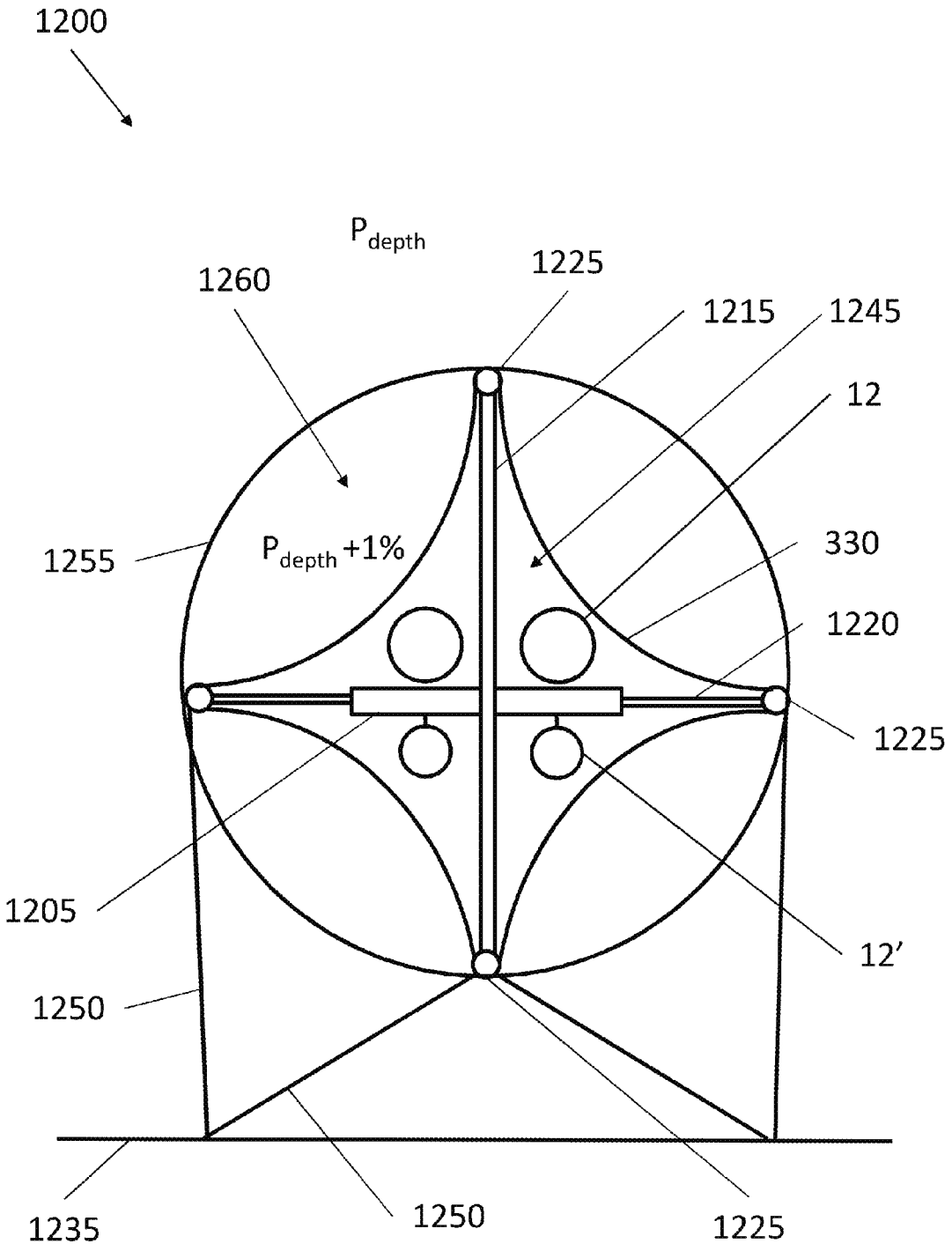
FIG. 12 illustrates a schematic view of an exemplary low-pressure environment structure in accordance with embodiments of the present disclosure.

FIG. 12 illustrates a schematic view of an exemplary low-pressure environment structure 1200 in accordance with embodiments of the present disclosure. In accordance with aspects of the disclosure, structure 1200 may be used in an under-water environment, and may comprise two levels of membranes 330, 1255. In accordance with aspects of the disclosure, the outer level creates a pocket with the inner level and is inflated with a gas, such as air, at a pressure slightly higher than the pressure in the ambient environment. The second membrane 330 separates the air-filled pocket from the near vacuum transportation corridor. This embodiment has a hydrodynamic outer profile. Should a leak be present between the air-filled pocket and the underwater environment a small amount of gas will be lost to the underwater environment. If a leak is present between the air filled volume and the near vacuum area, gas will enter the vacuum area and can easily be pumped out. This leads to an improved ability to handle leaks.

As shown in FIG. 12, structure 1200 includes a double-membrane structure, e.g., a plurality of sheets of flexible material (or membranes), for example, two levels of membranes. More specifically, structure 1200 includes flexible material 330, which defines a first enclosed environment 1245, and which is maintained as a low-pressure environment. As shown in FIG. 12, structure 1200 also includes flexible material 1255 (which may be the same material(s) as flexible material 330 or different materials), which defines a second enclosed environment 1260. As shown in FIG. 12, the pressure outside of the structure 1200 is $P_{depth}$, which is dependent upon the depth of the structure. In accordance with aspects of the disclosure, the second enclosed environment 1260 is maintained at a pressure that is, for example, higher (e.g., slightly higher) than the ambient pressure outside of the structure, e.g., $>P_{depth}$ or $P_{depth}+1\%$, with other higher pressures contemplated. With such an arrangement, if the flexible material 1255 is punctured, the higher pressure (e.g., $P_{depth}+1\%$) in the second enclosed environment 1260 pushing outwardly against the seawater will prevent or minimize any incoming water through the puncture and into the second enclosed environment 1260. Instead, air will flow from the second enclosed environment 1260 to the underwater environment, e.g., a small amount of gas will be lost to the underwater environment. If a leak is present between the air filled volume and the near vacuum area, gas will enter the vacuum area and can easily be pumped out with existing air pumps (e.g., used to maintain the low-pressure environment). In accordance with aspects of the disclosure, this exemplary structure 1200 leads to an improved ability to handle leaks. In embodiments, the structure 1200 may also include pumps (not shown) to remove any seawater that may enter the second enclosed environment 1260.

In accordance with aspects of the disclosure, as shown in FIG. 12, at least one sheet of flexible material 330 (or a membrane) is attached between the attachment structures 1225 to create an enclosed environment 1245. As the pressure in the second enclosed environment 1260 (e.g., $P_{depth}+1\%$) is greater than the pressure in the first enclosed environment 1245 (e.g., low-pressure), the flexible material 330 is held in tension between respective attachment structures 1225.

As shown in FIG. 12, the structure 1200 includes at least one track support platform 1205 for supporting capsules 12, 12" traveling through the transportation system. With this exemplary embodiment, the structure 1200 includes passages for two capsules 12, which ride above (or on) respective tracks (not shown) arranged on the track support platform 1205, and also includes passages for two capsules 12', which ride below (or hang from) respective tracks (not shown) arranged on the track support platform 1205.

A vertical support 1215 is arranged on (or between) the at least track support platform 1205, and includes attachment structures 1225 at the respective ends thereof thereof. As shown in FIG. 12, with this exemplary embodiment, two horizontal supports 1220 extend approximately horizontally from the at least track support platform 1205, and each include an attachment structure 1225 at the respective ends thereof. In embodiments, the vertical support 1215 and the two horizontal supports 1220 may be arranged approximately regularly-spaced along the path of the transportation system (e.g., every 100 to 150 feet).

As schematically depicted in FIG. 12, a plurality of supports 1250 are structured and arranged to connect the structure 1200 to the ground 1235 (e.g., the sea floor) via a secure attachment to the attachment structures 1225. In embodiments, the supports 1250 may be arranged to provide a redundant support structure. In embodiments, the supports 1250 may be pillars, beams, or other relatively rigid structure. In other contemplated embodiments, the supports 1250 may be flexible supports (e.g., cables, or wires) that are structured and arranged to maintain a relative position and/or orientation of the structure 1200. In accordance with aspects of the disclosure, the enclosed low-pressure environment 1245 will render the structure 1200 buoyant. In certain embodiments, the structure 1200 may additionally include one or more buoyancy devices, e.g., ballasts and/or buoys (not shown) structured and arranged to provide additional buoyancy to the structure 1200.

Figure 13:
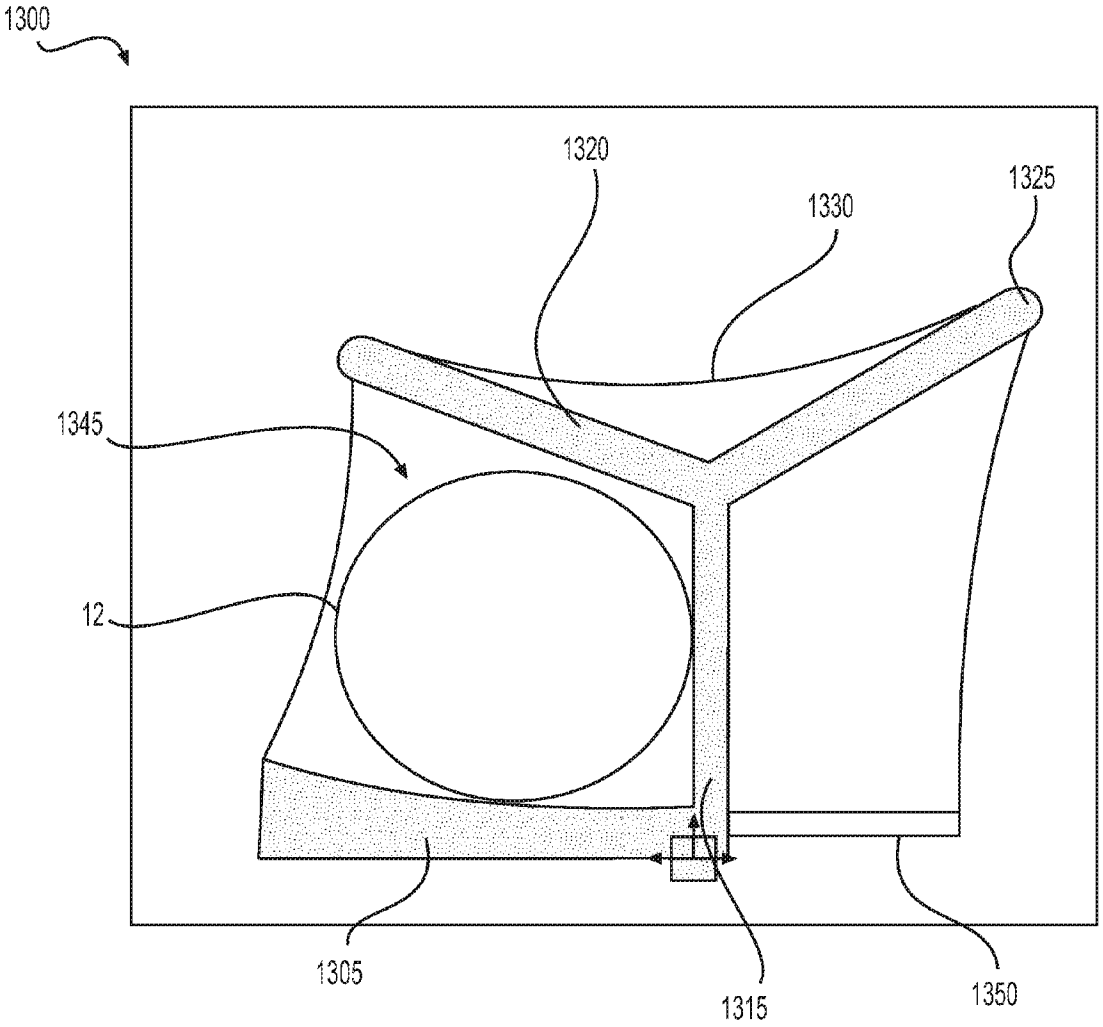
FIG. 13 illustrates a schematic view of a portion of an exemplary low-pressure environment structure in accordance with embodiments of the present disclosure.

FIG. 13 illustrates a schematic view of a cutaway portion of an exemplary low-pressure environment structure 1300 in accordance with embodiments of the present disclosure. As shown in FIG. 13, the structure 1300 includes at least one track support platform 1305 for supporting capsules 12 traveling through the transportation system. In embodiments, the at least one track support platform 1305 may be supported on pillars (not shown) or the ground (not shown). A vertical support 1315 is arranged on (or along) the at least one track support platform 1305. As shown in FIG. 13, two angled supports 1320 extend from the vertical support 1315, and each include an attachment structure 1325 at the respective ends thereof. In embodiments, a vertical support 1315 and the angled supports 1320 may be arranged in an approximately regularly-spaced relationship along the path of the transportation system (e.g., every 100 to 150 feet).

In accordance with aspects of the disclosure, as shown in FIG. 13, at least one sheet of flexible material 1330 (or a membrane) is attached between the attachment structures 325 and an end of the track support platform 1305 to create an enclosed environment 1345. The flexible material 1330 is held in tension between respective attachment structures 1325 and between the attachment structures 1325 and an end of the track support platform 1305. In some embodiments, the structure may include at least one walkway 1350, e.g., a maintenance walkway, adjacent the capsule transportation path that is within the enclosed environment 1345.

In accordance with additional aspects of the disclosure, the lengths and diameters (or widths) of support structures (e.g., of the vertical support 1315 and/or the two angled supports 1320 with the example of FIG. 13) may be optimized to balance material usage and strength. For example, a minimum amount of material may be used to achieve the design strength (e.g., with a safety factor or margin).

Figure 14:
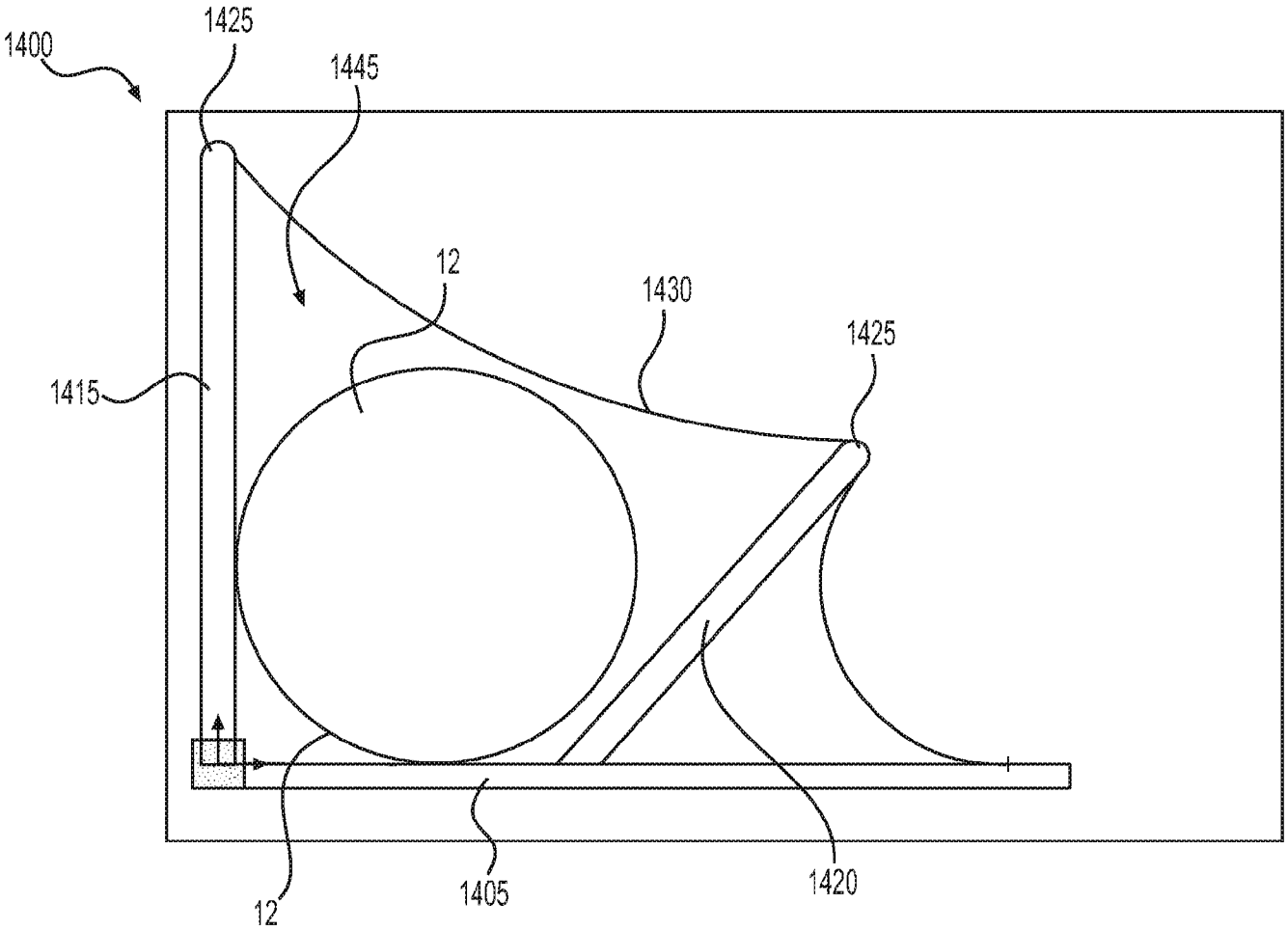
FIG. 14 illustrates a schematic view of a portion of an exemplary low-pressure environment structure in accordance with embodiments of the present disclosure.

FIG. 14 illustrates a schematic view of a portion of an exemplary low-pressure environment structure in accordance with embodiments of the present disclosure. Embodiments include the structure depicted in FIG. 14 alone, and the structure depicted in FIG. 14 together with a corresponding approximate mirror-image structure, which is not shown (e.g., arranged to the left of the depicted embodiment).

As shown in FIG. 14, the structure 1400 includes at least one track support platform 1405 for supporting capsules 12 traveling through the transportation system. In embodiments, the at least one track support platform 1405 may be supported on pillars (not shown) or the ground (not shown). A vertical support 1415 is arranged on (or along) the at least one track support platform 1405, with an attachment structure 1425 on an end thereof. As should be understood from FIG. 14, two angled supports 1420 (only one shown) extend from the track support platform 1405, and each includes an attachment structure 1425 at the respective ends thereof. In embodiments, the vertical support 1415 and the two angled supports 1420 may be arranged approximately regularly-spaced (e.g., at regularly-spaced intervals) along the path of the transportation system. In certain embodiments, the angled supports 1420 may be solid or opaque. In other contemplated embodiments, the angled supports 1420 may be transparent, translucent, and/or include holes (or windows) there-through.

In accordance with aspects of the disclosure, as shown in FIG. 14, at least one sheet of flexible material 1430 (or a membrane) is attached between the attachment structures 1425 and an end of the track support platform 1405 to create an enclosed environment 1445. The flexible material 1430 is held in tension between respective attachment structures 1425 and between the attachment structures 1425 and an end of the track support platform 1405.

In accordance with aspects of the disclosure, in some embodiments different flexible materials may be used for different portions of the structure 1400. For example, in some embodiments, a higher strength material (e.g., a membrane embedded with steel fibers) may be used as a flexible material between the vertical support 1415 and an angled support 1420, and a lower-strength material (which may be, for example, at least partially see-through) may be used as a flexible material between angled support 1420 and the track support platform 1405.

Figure 15A:
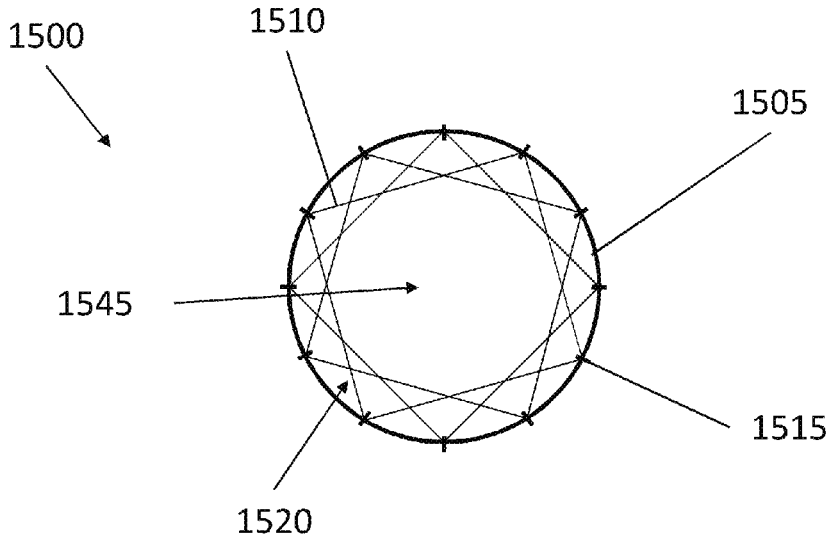
FIGS. 15A-15B illustrate schematic views of a portion of an exemplary low-pressure environment structure in accordance with embodiments of the present disclosure.
Figure 15B:
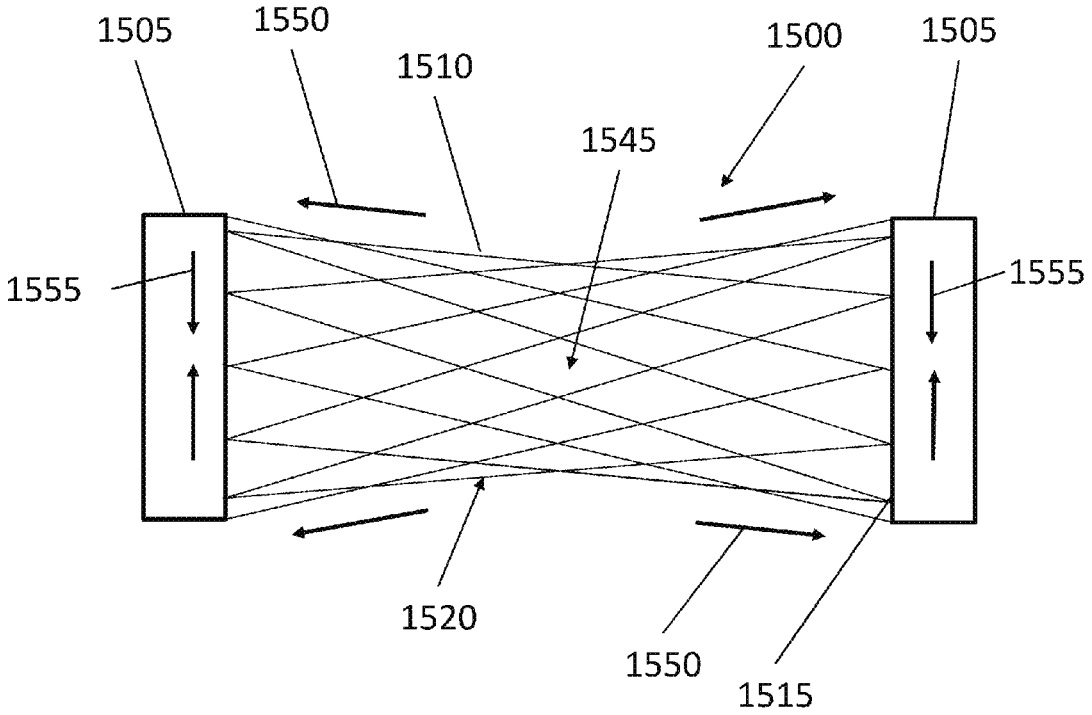

FIGS. 15A-15B illustrate schematic views of a portion of an exemplary low-pressure environment structure 1500 in accordance with further embodiments of the present disclosure. As shown in FIG. 15A, structure 1500 includes a plurality of support rings 1505 between which support wires 1510 (e.g., cables, fibers, webs, or filaments) are attached at attachments 1515 (e.g., hooks, fasteners). The support rings 1505 are structured and configured as compression rings to withstand the compressive forces 1555 due to the support wires, which are in tension 1550. With this exemplary embodiment, structure 1500 places the tension into fibers or support wires 1510. The support rings 1505, which may be made of materials strong in compression, such as concrete, for example, are configured as the main elements to withstand the compressive forces. The support rings 1505 are spaced at a distance (e.g., a specified and/or regularly) from each other, and each support ring 1505 having a central axis that is substantially parallel to the other support rings 1505 along the transportation path. A plurality of high tensile, high strength support wires 1510 (or support fibers), such as steel or aromatic polyamide fibers, are attached to an outer circumference of each ring 1505, and connect the rings 1505. In embodiments, the support wires 1510 (or fibers) may be wound around the support rings 1505 such that a position of a respective fiber rotates about the ring by some angle for each successive ring. Thus, even though, in embodiments, the fibers are tensioned to be fairly straight, the structure 1500 may appear to have hyperbolic shape from the side. In accordance with aspects of the disclosure, this angular pattern also allows the structure 1500 to efficiently resist shear loads (side loads). A flexible material 1520 is arranged around and supported by the plurality of support wires 1510 and attached to the support rings 1505 to create an enclosed environment 1545 (which may be configured as a low-pressure environment). For example, an "outer skin" flexible material 1520 comprising, for example, a polymer, such as polyethylene, a metal, or another material impermeable to air, is wrapped around the outside surface of the fiber mesh and support rings 1505 (or compression rings) to form a "tube."

This embodiment may also utilize, for example, a flexible material 1520 comprising a thin plastic film layered around high strength filaments, e.g., Kevlar or carbon fiber. In accordance with aspects of the disclosure, utilizing these filaments in such a structure improves the strength and load path of the material and allows the filaments to remain thin, while accommodating and/or allowing larger radiuses of curvature with potentially larger spans between areas of support and thinner overall membrane than an unreinforced film. In accordance with aspects of the disclosure, in some embodiments, the fibers on or embedded in the flexible material 1520 may also act as tear stops and prevent a breach in the flexible material 1520 from spreading.

As shown in FIGS. 15A and 15B, with an exemplary and non-limiting embodiment, the support wires 1510 may have a 90° clocking (e.g., both −90° clocking and +90° clocking) between respective support rings 1505. For example, with a 90° clocking arrangement, a support wire 1510 is attached to a first support ring at the "12 o'clock" position and is attached to the second support ring at the "3 o'clock" position (i.e., 90° clockwise). A second support wire 1510 is also attached to the first support ring 1505 at the "12 o'clock" position and is attached to the second support ring 1505 at the "9 o'clock" position (i.e., 90° counter-clockwise). By attaching two support wires 1510 from each clock position (i.e., from each of twelve points on the first support ring 1505) to twelve points on a second support ring, in this manner (e.g., with the 90° clocking), a support structure as shown in FIG. 15B is obtained. In accordance with aspects of the disclosure, such a 90° clocking provides high (e.g., maximum) effect of angle while allowing sufficient cross-sectional area for capsule passage there-through. While the exemplary embodiment has twelve connection points 1515 on each support ring, the disclosure contemplates that greater (or fewer) connection points 1505 may be utilized.

In embodiments, the support wires 1510 may comprise steel, Dyneema®, fabrics, high-strength fibers, amongst other contemplated materials having suitable properties. In embodiments, the flexible material 1520 may include a plastic membrane, for example, having UV-resistance In further embodiments, for example, fibers (e.g., carbon fibers) may be infused in flexible material (or fabric) or along the flexible material.

In embodiments, plastic materials could be melt bonded together quickly and cheaply in order to seal the structure between "tube" sections. An alternative embodiment may use any number of metal materials for the flexible material 1520. Another alternative embodiment may use plastic materials that provide sections that are transparent to light so that passengers inside the pod are able to see out.

In accordance with aspects of the disclosure, structure 1500 may be easier to manufacture due to for example, lighter and/or cheaper materials, e.g., as compared to a steel tube sized to provide an equivalent capsule passageway. Thus, by implementing such a structure 1500, the costs for manufacturing and installing the transportation system may be reduced, lowering the costs of implementation for the transportation system.

Figure 16A:
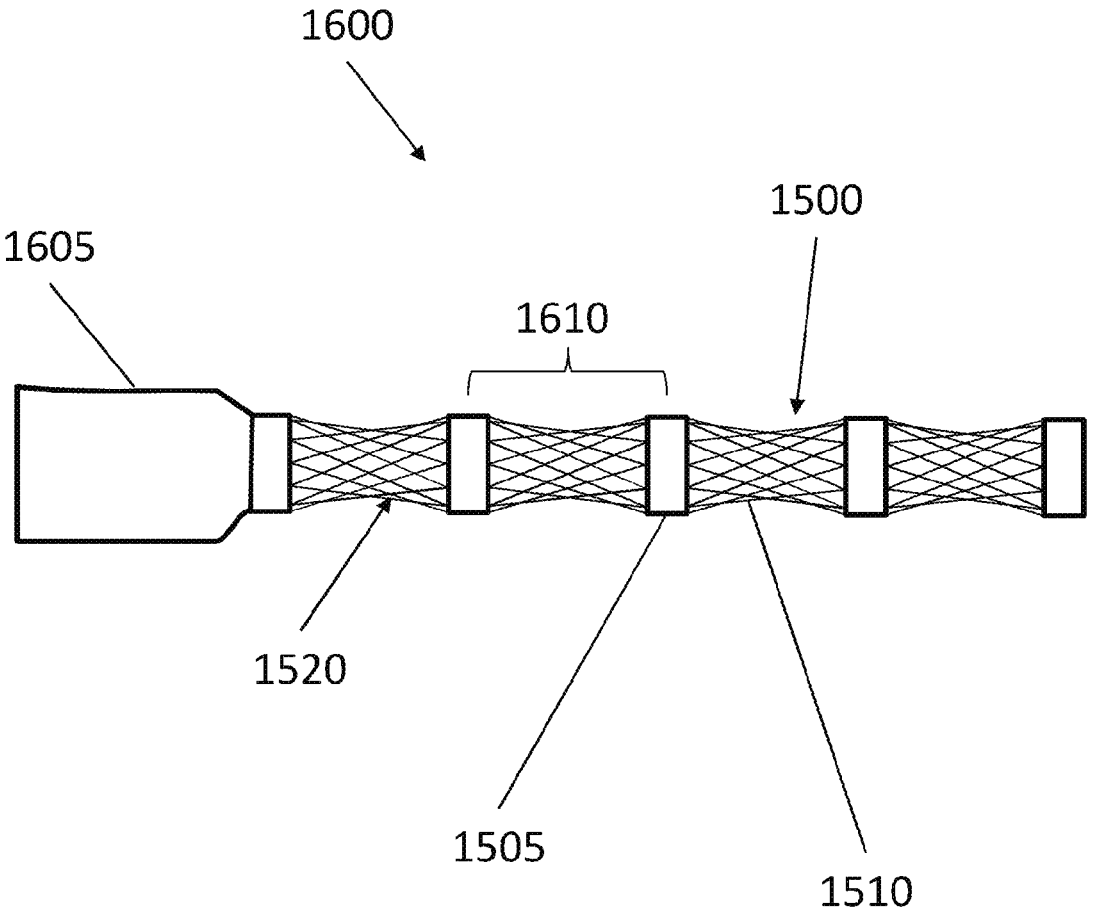
FIGS. 16A-16B illustrate schematic views of a portion of an exemplary low-pressure environment structure in accordance with embodiments of the present disclosure.
Figure 16B:
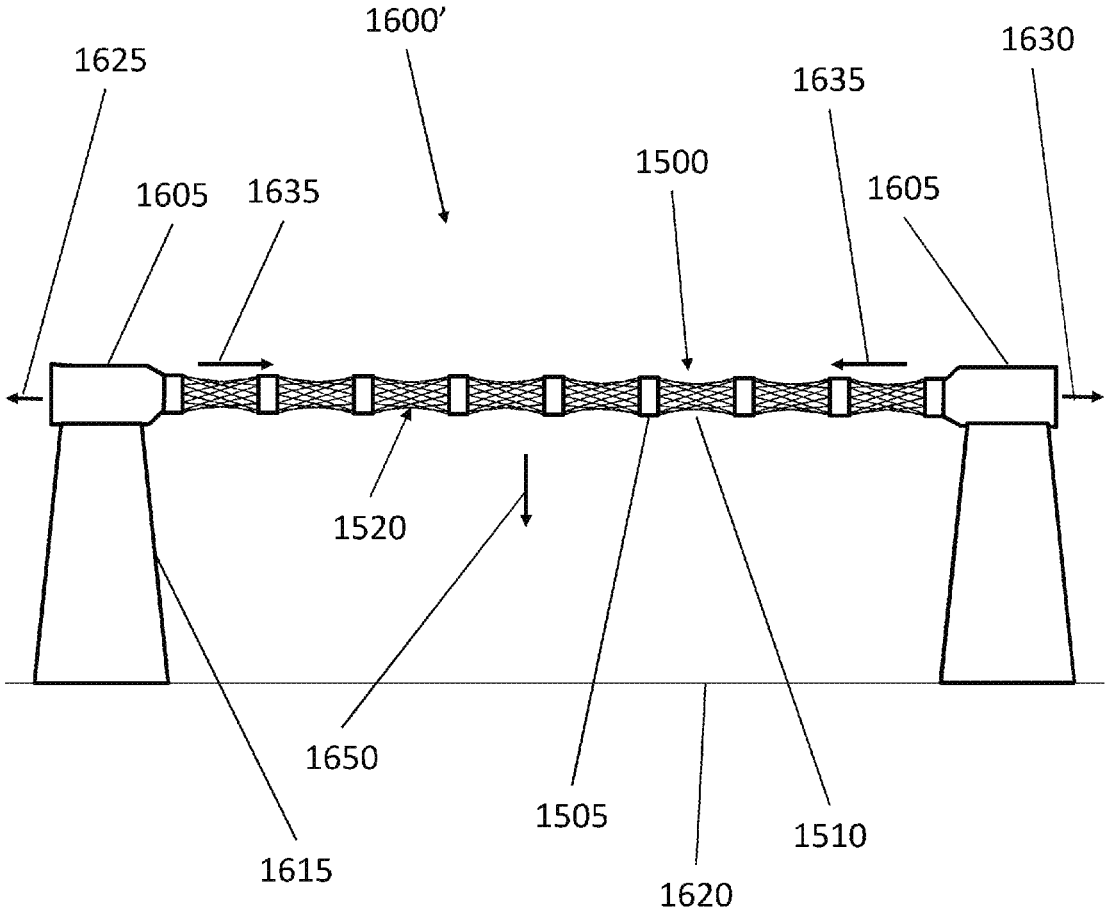

FIGS. 16A-16B illustrate schematic views of a portion of an exemplary low-pressure environment structure 1600 in accordance with embodiments of the present disclosure. As shown in in FIG. 16A, structure 1600 comprises a plurality of structures 1500 connected to one another (in embodiments, with adjacent shared support rings 1505 between the plurality of support wires 1510). In embodiments, the support rings 1505 may be spaced (e.g., approximately regularly) from one another by a distance 1610. In some exemplary and non-limiting embodiments, the distance 1610 may be approximately every 12 meters.

As shown in FIG. 16A, an anchor structure 1605 (e.g., an "end-cap") may be arranged on at least one end of the tube path. In accordance with aspects of the disclosure the anchor structure 1605 may be configured to withstand the tension forces acting along the transportation path (for example, in a similar manner to anchor structures for suspension bridges). In some embodiments, the anchor structure 1605 may comprise steel and/or concrete. In some embodiments, the anchor structure 1605 attaches the support wires 1510 to the ground so as to bear the tension of the tube.

FIG. 16B illustrates a schematic view of a portion of an exemplary low-pressure environment structure 1600' in accordance with embodiments of the present disclosure. As shown in FIG. 16B, a plurality of anchor structures 1605 may be arranged on ends of the tube path portions. In some embodiments, the anchor structures 1605 may be securely attached (e.g., cemented, welded, fastened) to, e.g., the top portions of respective pylons (or pillars) 1615 structured and arranged on the ground 1620. In accordance with aspects of the disclosure the anchor structure 1605 and the pylons 1620 may be configured to provide offsetting forces 1625, 1630 to withstand (or counter) the tension forces 1635 and gravitational forces 1650 acting along the transportation path (for example, in a similar manner to support structures for suspension bridges). In embodiments, the support rings 1505 (or compression rings) may be used as connections to additional pylons (not shown) for additional structural support. There can also be additional anchor structures, similar to the anchor structures 1605, which are configured to connect different spans of the tube, so that the tension is maintained in the span between the midcaps.

With an exemplary and non-limiting embodiment, three or four support rings 1505 may be spaced (e.g., approximately regularly) between pylons (or pillars), which may be spaced approximately every 50 meters.

These exemplary embodiments differ from a tubular structure designed in compression. The hyperboloid tensile structure has the advantage of not having to withstand substantial buckling forces, which may be a problem for compressed structures. Instead, compression forces are concentrated in a relatively small fraction of the tube, the support rings 1505 (e.g., the compression rings). Because the support rings 1505 may not bear any tensile loads, they can be made of concrete, as opposed to steel, which may reduce costs. Since tensile structures are much more efficient in converting ultimate material strength to load bearing capacity, tensile structures offer a potential savings in amount and cost of material. Another advantage of these embodiments is the structure's ability to deal with thermal expansion. For example, pipeline materials may shrink or contract along their length, creating additional stress forces within the system. In accordance with aspects of the disclosure, the hyperboloid structure, however, will naturally deal with contraction and expansion. The fibers will contract or expand, thus increasing or decreasing tension within the operating bounds of the design. Thus, in accordance with aspects of the disclosure, the hyperboloid tube structure may be simpler to construct, since, for example, no special joints (e.g., expansion joints) may be necessary.

Figure 17A:
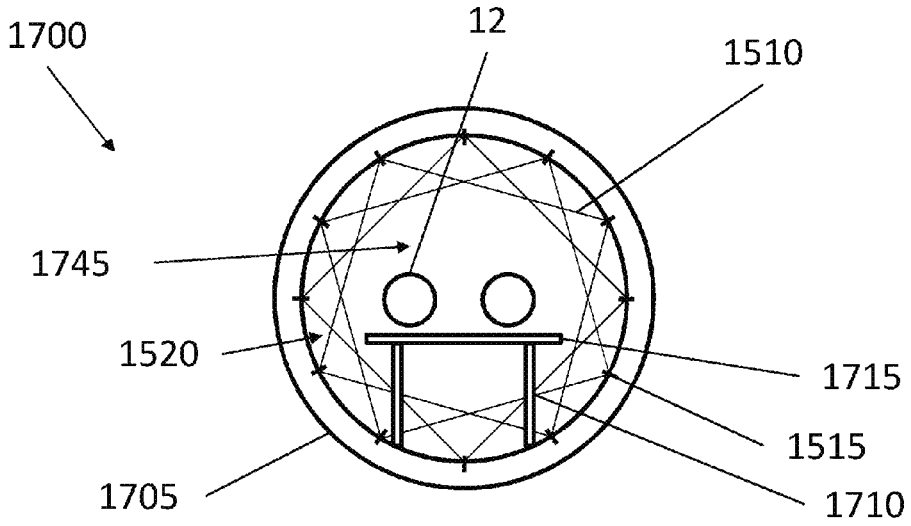
FIGS. 17A-17B illustrate schematic cross-sectional views of a portion of an exemplary low-pressure environment structure in accordance with embodiments of the present disclosure.
Figure 17B:
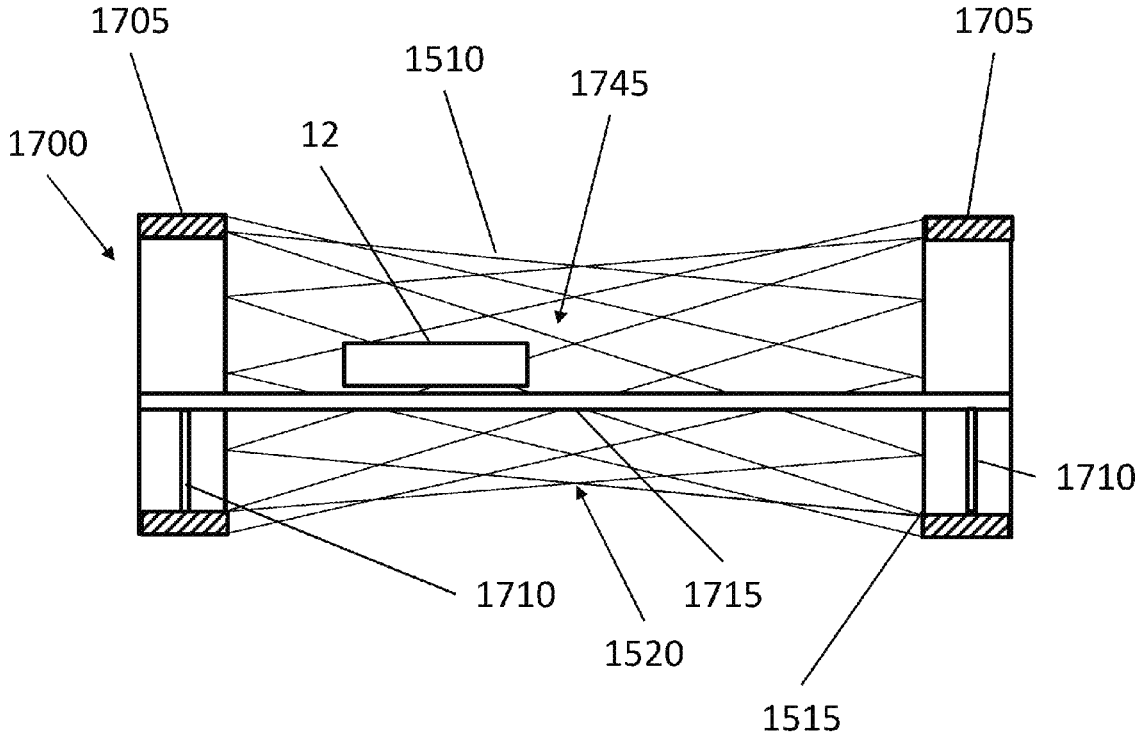

FIGS. 17A-17B illustrate schematic cross-sectional views of a portion of an exemplary low-pressure environment structure 1700 in accordance with embodiments of the present disclosure. As shown in FIG. 17A, structure 1700 includes a plurality of support rings 1705 between which support wires 1510 (e.g., cables, fibers, webs) are attached at attachments 1515 (e.g., hooks, fasteners). The support rings 1705 are structured and configured as compression rings to withstand the compressive forces due to the support wires 1510, which are in tension. A flexible material 1520 is arranged around and supported by the plurality of support wires 1510 and attached to the support rings 1705 to create an enclosed environment 1745 (which may be configured as a low-pressure environment). In another exemplary embodiment, a flexible material 1520 is arranged around and supported by the plurality of support wires 1510 and the support rings 1705 to create an enclosed environment 1745.

As schematically illustrated in FIGS. 17A and 17B, a track support platform 1715 is arranged in the enclosed environment 1745 of the structure 1700. The track support platform 1715 is structured and configured to provide at least one transportation path for a capsule 12. The track support platform 1715 may be supported by platform supports 1710, which may be secured to adjacent support rings 1705. In certain embodiments, the track support platform 1715 and the platform supports 1710 may be structured and configured to provide additional stiffness to the structure 1700 (or to a plurality of structures 1700 connected together).

Figure 18:
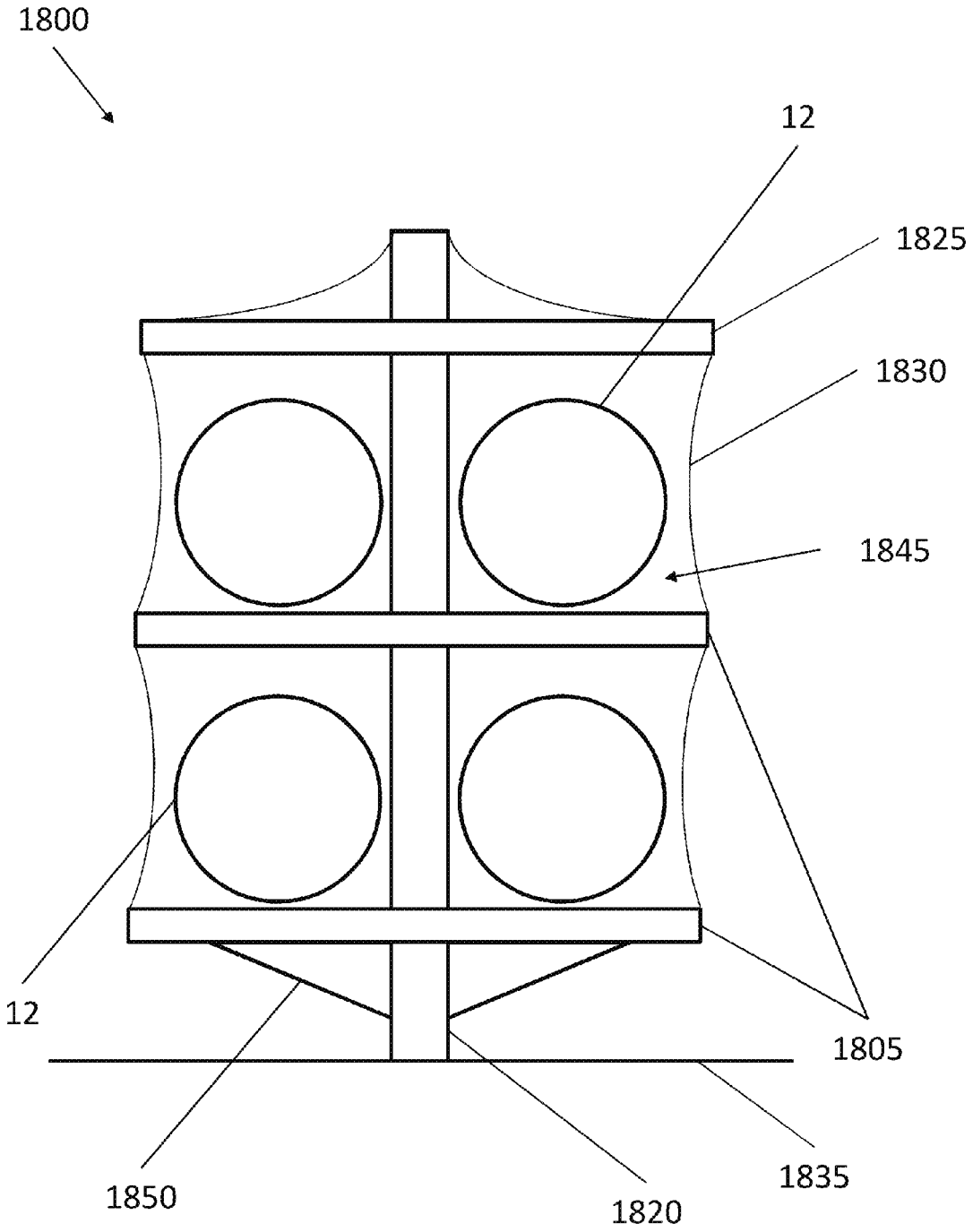
FIG. 18 illustrates a schematic view of a portion of an exemplary low-pressure environment structure in accordance with embodiments of the present disclosure.

FIG. 18 illustrates a schematic view of a portion of an exemplary low-pressure environment structure 1800 in accordance with embodiments of the present disclosure. As shown in FIG. 18, structure 1800 includes at least one track support platform 1805 for supporting capsules 12 traveling through the transportation system. In embodiments, the at least one track support platform 1805 may be supported on a pillar 1820 on the ground 1835. With this exemplary embodiment, two track support platforms 1805 and an upper support 1825 are secured to the pillar 1820. As shown in FIG. 18, a plurality of pillar supports 1850 may be attached to the pillar 1820 and structured and arranged to support one or more of the two track support platforms 1805 and/or the upper support 1825 (not shown).

In accordance with aspects of the disclosure, as shown in FIG. 18, at least one sheet of flexible material 1830 (or a membrane) is attached between the track support platforms 1805 and the pillar 1820 to create an enclosed environment 1845. The flexible material 1830 is held in tension between the track support platforms 1805 and the pillar 1820.

Figure 19A:
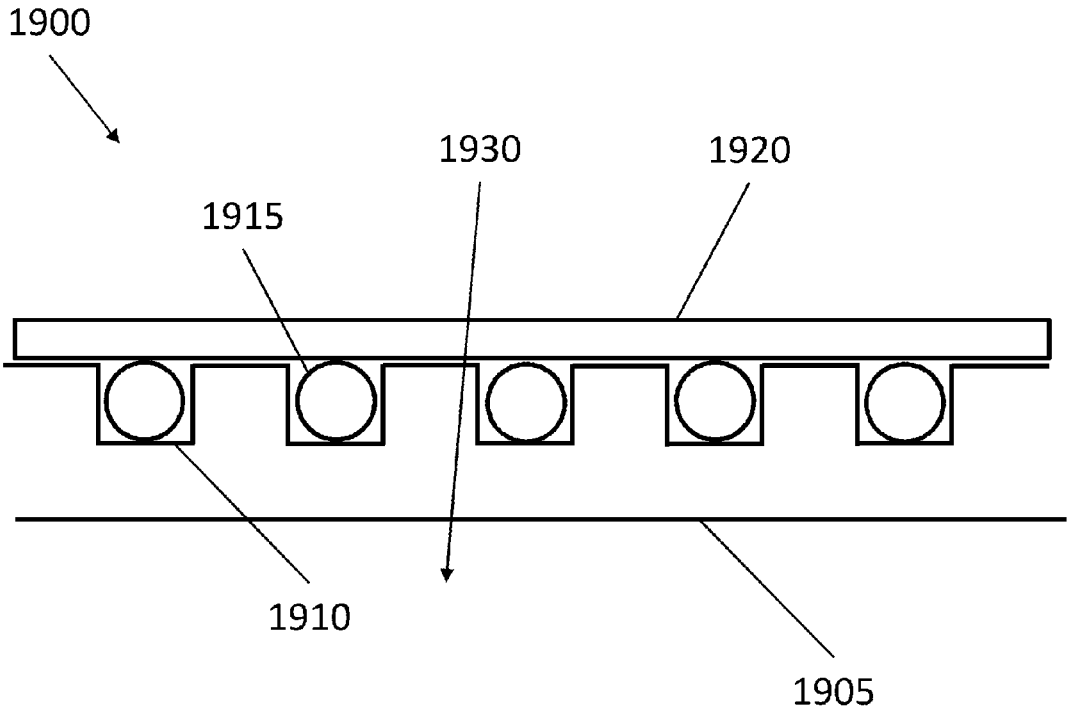
FIGS. 19A-19B illustrate schematic views of a portion of exemplary low-pressure environment support structures in accordance with embodiments of the present disclosure.
Figure 19B:
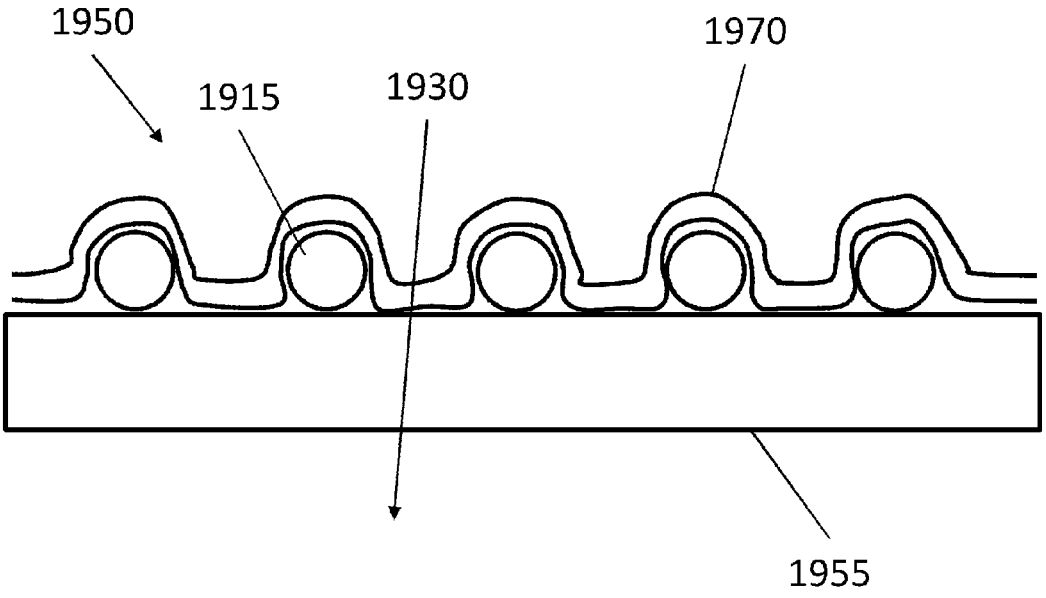

FIGS. 19A-19B illustrate schematic views of a portion of an exemplary low-pressure environment support structure in accordance with embodiments of the present disclosure. In embodiments, support wires may be used to additionally support the flexible material. As shown with the arrangement 1900 in FIG. 19A, a support structure 1905 (e.g., a track support platform, an angled support, a support pillar, support ring, a box girder structure, and/or attachment structure) for forming an enclosed environment includes channels 1910 structured and arranged to accommodate respective support wires 1915. In accordance with aspects of the disclosure, a flexible material 1920 is arranged around the support structure 1905 and the support wires 1915 to form one or more enclosed environments 1930. As shown with the arrangement 1900, by utilizing the channels 1910, the flexible material 1920 may be more evenly supported by the support structure 1905 and the support wires 1915, which may prevent or reduce wrinkles and/or uneven stresses on the flexible material 1920. In embodiments, the spacing of the channels 1910 and the size of the channels 1910 may be modified, for example, depending on the size and type of support wires 1915 used.

As shown with the arrangement 1950 in FIG. 19B, a support structure 1955 (e.g., a track support platform, an angled support, a support pillar, support ring, a box girder structure, and/or attachment structure) for forming enclosed environment has support wires 1915 arranged on the surface thereof. In accordance with aspects of the disclosure, a flexible material 1970 is arranged around the support structure 1955 and the support wires 1915 to form one or more enclosed environments 1930 (as schematically indicated). As shown with the arrangement 1950, the flexible material 1970 may wrap approximately around the support wires 1915.

Figure 20A:
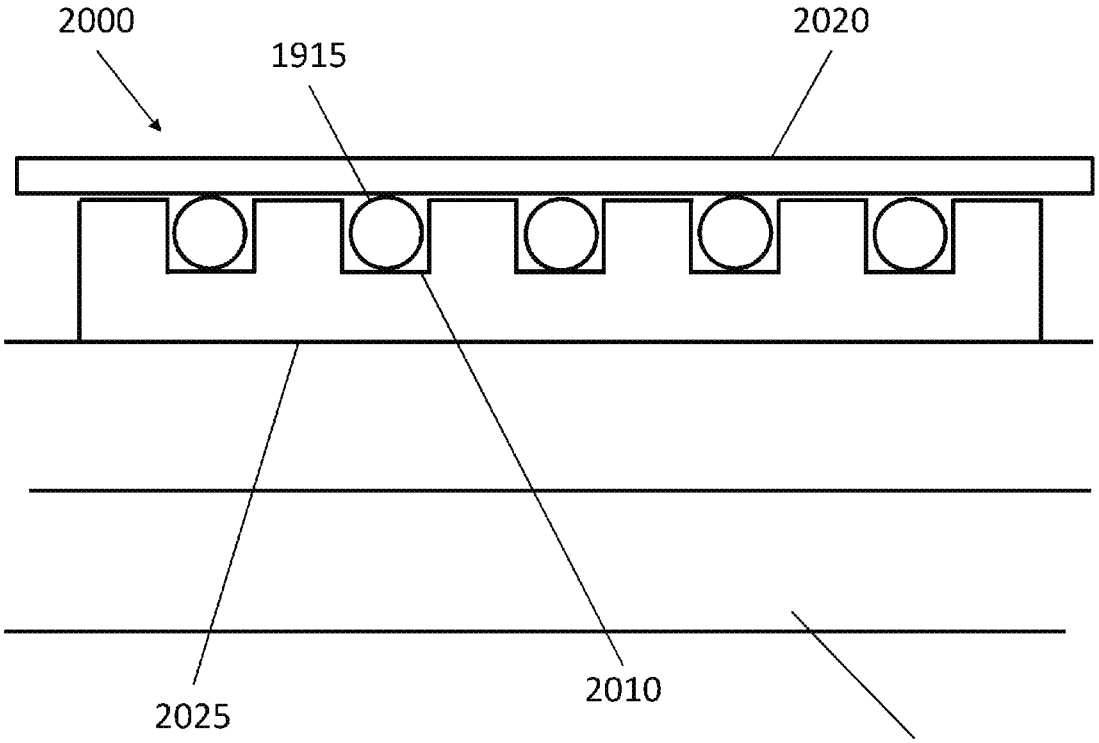
FIGS. 20A-20B illustrate schematic views of a portion of an exemplary low-pressure environment support structure in accordance with embodiments of the present disclosure.
Figure 20B:
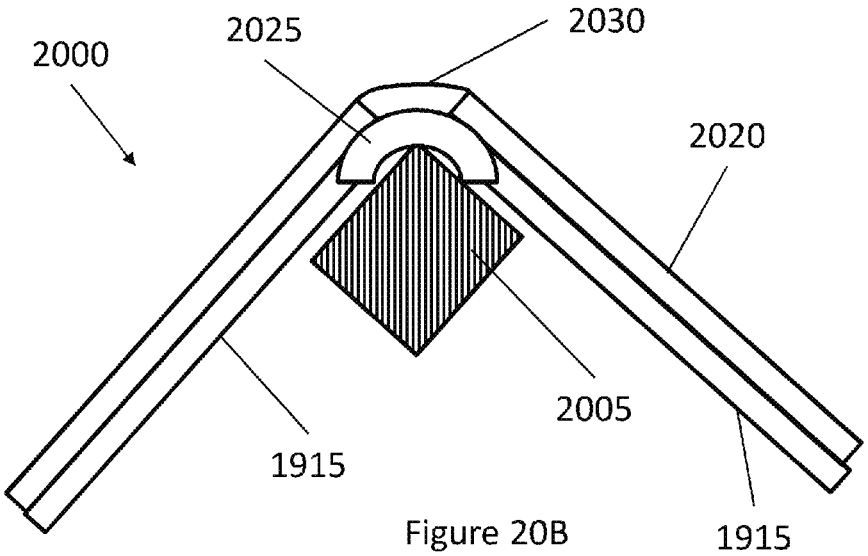

FIGS. 20A-20B illustrate schematic views of a portion of an exemplary low-pressure environment support structure 2000 in accordance with embodiments of the present disclosure. As shown in FIG. 20A, a wire support structure 2025 having channels 2010 structured and arranged to accommodate respective support wires 1915 may be arranged on a support structure 2005 (e.g., a track support platform, an angled support, a support pillar, support ring, a box girder structure, and/or attachment structure) for forming an enclosed environment. In accordance with aspects of the disclosure, a flexible material 2020 is arranged around the wire support structure 2025, the support structure 2005 and the support wires 1915 to form one or more enclosed environments. As shown with the arrangement 2000, by utilizing the wire support structure 2025 the bending induced in the support wires 1915 and/or the flexible material 2020 may be reduced. As the radius around which support wires 1915 and/or the flexible material 2020 decreases, the ability for the material to endure the tensile forces decreases. As such, by increasing the radius of the bend using the wire support structure 2025, the ability for the materials (e.g., support wires 1915 and/or flexible material 2020) to endure the tensile forces may be increased. Furthermore, by increasing the surface contact of the support wires 1915 as they bend around the support structure 2005, wear on the support wires can be reduced. As shown in FIG. 20B, in some embodiments, the flexible material 2020 may include one or more reinforcement regions 2030, for example arranged in proximity to the bend, which are configured to have greater strength and/or resistance to tear, for example.

Figure 21:
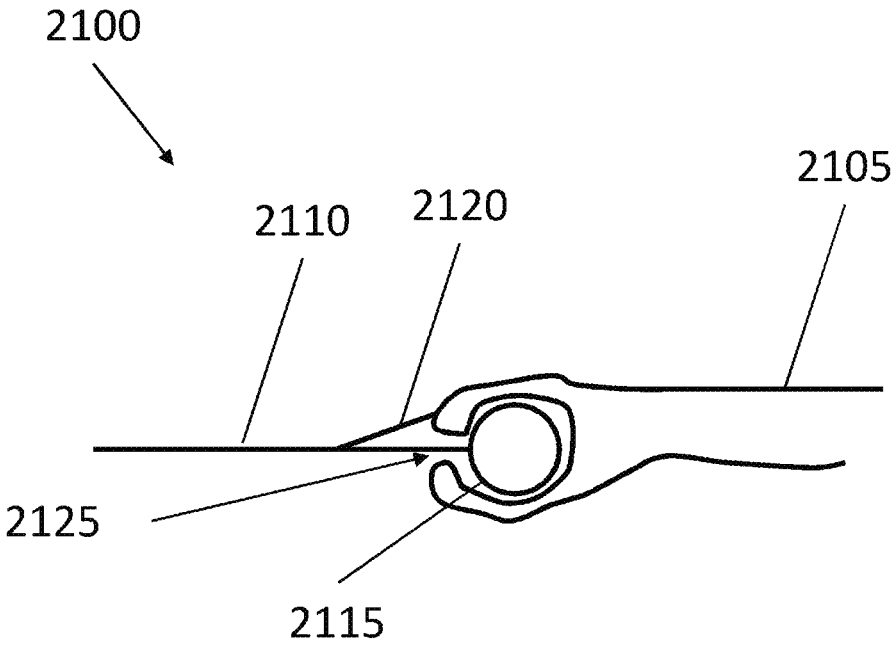
FIG. 21 illustrates a schematic view of an exemplary low-pressure environment connector structure in accordance with embodiments of the present disclosure.

FIG. 21 illustrates a schematic view of an exemplary low-pressure environment connector structure in accordance with embodiments of the present disclosure. As shown in FIG. 21, a flexible material 2110 may include a plurality of attachment beads 2115 (or rods, for example) along a periphery thereof or through a central portion thereof. The attachment beads 2115 (or rods) are structured, arranged, and configured to cooperatively engage with a corresponding slot 2125 (or groove) in an attachment structure 2105. As shown in FIG. 21, a sealing flap 2120 may be flexibly (pivotally) mounted to the attachment structure 2105 and configured to press against the flexible material 2110 to form a seal therewith. In embodiments, the sealing flap 2120 may be mounted in a flexed manner to provide a sealing force. In additional embodiments, the sealing flap 2120 may include an adhesive or other suitable securing material to enhance the seal provided between the sealing flap 2120 and the flexible material 2110.

Another embodiment of the present disclosure may be used to create a junction or track switching location. For example, rather than centering around one vacuum transportation corridor, the system can take on numerous shapes to center around a large area of land or water. The tension members then support the membrane similar to a tent, allow for the intersection of tubes within the confines of the low-pressure environment.

Although the present specification describes components and functions that may be implemented in particular embodiments with reference to particular standards and protocols, the disclosure is not limited to such standards and protocols. Such standards are periodically superseded by faster or more efficient equivalents having essentially the same functions. Accordingly, replacement standards and protocols having the same or similar functions are considered equivalents thereof.

The illustrations of the embodiments described herein are intended to provide a general understanding of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, while many of the structures discussed herein may be used in the context of a low-pressure environment for a high-speed transportation system, the enclosed environments may also be utilized in different contexts (e.g., vacuum facilities for clean rooms). Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

Accordingly, the present disclosure provides various systems, structures, methods, and apparatuses. Although the disclosure has been described with reference to several exemplary embodiments, it is understood that the words that have been used are words of description and illustration, rather than words of limitation. Changes may be made within the purview of the appended claims, as presently stated and as amended, without departing from the scope and spirit of the disclosure in its aspects. Although the disclosure has been described with reference to particular materials and embodiments, embodiments of the invention are not intended to be limited to the particulars disclosed; rather the invention extends to all functionally equivalent structures, methods, and uses such as are within the scope of the appended claims.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the invention has been described with reference to specific embodiments, those skilled in the art will understand that various changes may be made and equivalents may be substituted for elements thereof without departing from the true spirit and scope of the invention. While exemplary embodiments are described above, it is not intended that these embodiments describe all possible forms of the invention. Rather, the words used in the specification are words of description rather than limitation, and it is understood that various changes may be made without departing from the spirit and scope of the disclosure. In addition, modifications may be made without departing from the essential teachings of the invention. Furthermore, the features of various implementing embodiments may be combined to form further embodiments of the invention.

What is claimed is:

1. A high-speed transportation system, the system comprising:

at least one enclosed volume that is configured to be maintained as a low-pressure environment;

at least one track along a transportation path within the at least enclosed volume; and a plurality of capsules configured for travel through the at least one enclosed volume between stations, wherein the at least one enclosed volume is at least partially defined by at least one flexible material structured and arranged to withstand a tensile load.

2. The high-speed transportation system of claim 1, further comprising at least one support structure configured to support the flexible material and structured and arranged to withstand a compressive load.

3. The high-speed transportation system of claim 2, wherein the at least one support structure comprises a plurality of support rings, and the system additionally comprises a plurality of support wires connected between two of the plurality of support rings, wherein the at least one flexible material is at least supported by the plurality of support wires.

4. The high-speed transportation system of claim 3, wherein the plurality of support wires between adjacent support rings are configured with a 90° clocking.

5. The high-speed transportation system of claim 3, wherein the support wires comprise at least one of: steel, fibers, polymer materials, webbing, and filaments.

6. The high-speed transportation system of claim 2, wherein the at least one support structure comprises an arch structure.

7. The high-speed transportation system of claim 2, further comprising a second flexible material structured and arranged to define a second enclosed volume that encloses the first enclosed volume, and which is configured to be maintained at a pressure higher than a pressure outside of the second enclosed volume.

8. The high-speed transportation system of claim 7, wherein the second enclosed volume is arranged in an underwater environment.

9. The high-speed transportation system of claim 2, wherein the at least one support structure comprises at least one vertical support.

10. The high-speed transportation system of claim 9, wherein the at least one flexible material together with the at least one vertical support defines the at least one enclosed volume.

11. The high-speed transportation system of claim 2, wherein the at least one support structure comprises a plurality of support structures spaced along the transportation path.

12. The high-speed transportation system of claim 2, wherein the at least one support structure comprises at least one angled support.

13. The high-speed transportation system of claim 12, wherein the at least one angled support extends in a downwardly direction.

14. The high-speed transportation system of claim 12, wherein the at least one angled support is attached to a track support platform.

15. The high-speed transportation system of claim 12, wherein the at least one angled support is attached to at least one vertical support.

16. The high-speed transportation system of claim 12, wherein the at least one angled support extends in an upwardly direction.

17. The high-speed transportation system of claim 1, wherein the system additionally comprises at least one track support platform.

18. The high-speed transportation system of claim 1, wherein the at least one flexible material together with the at least one track support platform defines the at least one enclosed volume.

19. The high-speed transportation system of claim 1, wherein the flexible material defines the at least one enclosed volume.

20. The high-speed transportation system of claim 1, further comprising at least one guideway or walkway arranged within the at least one enclosed volume.

21. The high-speed transportation system of claim 1, wherein the tensile load is due at least in part to a pressure differential between the low-pressure environment of the enclosed volume, and an ambient pressure outside the enclosed volume.

22. The high-speed transportation system of claim 1, wherein the at least one flexible material comprises at least one of:

a plastic membrane;

a plastic membrane having embedded filaments;

a layer of metal;

a translucent material; and a transparent material.

23. The high-speed transportation system of claim 1, wherein the at least one flexible material is impermeable to air.

24. The high-speed transportation system of claim 1, further comprising:

a propulsion system adapted to propel the at least one capsule through the enclosed volume; and a levitation system adapted to levitate the capsule within the enclosed volume.

25. A structure, comprising:

at least one flexible material structured and arranged to withstand a tensile load;

at least one support structure configured to support the flexible material and structured and arranged to withstand a compressive load; and at least one enclosed volume at least partially defined by the at least one flexible material, the enclosed at least one volume being configured to be maintained as a low-pressure environment for a high-speed transportation system.

26. The structure of claim 25, further comprising at least one track along a transportation path within the at least enclosed volume, wherein the at least one track is configured for supporting a capsule configured for travel through the at least enclosed volume.

* * * * *